US007855625B2

(12) United States Patent
Varga et al.

(10) Patent No.: US 7,855,625 B2
(45) Date of Patent: Dec. 21, 2010

(54) LAMP TRANSFORMER

(75) Inventors: Viktor Karoly Varga, Solon, OH (US); Bruce Roberts, Mentor on the Lake, OH (US)

(73) Assignee: General Electric Company, Schenectady, NY (US)

( * ) Notice: Subject to any disclaimer, the term of this patent is extended or adjusted under 35 U.S.C. 154(b) by 1010 days.

(21) Appl. No.: 11/646,009

(22) Filed: Dec. 27, 2006

(65) Prior Publication Data

US 2008/0055814 A1 Mar. 6, 2008

Related U.S. Application Data

(63) Continuation-in-part of application No. 11/513,777, filed on Aug. 31, 2006, now Pat. No. 7,760,061.

(51) Int. Cl.
*H01F 27/02* (2006.01)

(52) U.S. Cl. ..... 336/90; 336/192

(58) Field of Classification Search ..... 315/56, 315/58, 276; 336/61, 90, 155, 192
See application file for complete search history.

(56) References Cited

U.S. PATENT DOCUMENTS

| | | | |
|---|---|---|---|
| 4,156,222 | A | 5/1979 | Rossman et al. |
| 4,677,348 | A | 6/1987 | Schweickardt |
| 4,902,943 | A | 2/1990 | Nicholson et al. |
| 5,122,174 | A | 6/1992 | Sunder et al. |
| 5,159,242 | A | 10/1992 | Ravi |
| 5,185,560 | A | 2/1993 | Nilssen |
| 5,228,770 | A | 7/1993 | Brunson |
| 5,485,057 | A | 1/1996 | Smallwood et al. |
| 5,510,967 | A | 4/1996 | Coushaine et al. |
| 5,600,208 | A | 2/1997 | Katou et al. |
| 5,659,221 | A | 8/1997 | Coushaine et al. |
| 5,828,174 | A | 10/1998 | Seiler et al. |
| 5,838,109 | A | 11/1998 | Kobayashi et al. |
| 5,892,332 | A | 4/1999 | Drews et al. |
| 5,894,202 | A | 4/1999 | Betz et al. |
| 6,154,113 | A | 11/2000 | Murai |
| 6,181,081 | B1 | 1/2001 | Hirschmann et al. |
| 6,194,834 | B1 | 2/2001 | Seiler et al. |
| 6,364,515 | B1 | 4/2002 | Daub et al. |

(Continued)

FOREIGN PATENT DOCUMENTS

| | | |
|---|---|---|
| DE | 197 51 548 C2 | 6/1999 |

(Continued)

OTHER PUBLICATIONS

Colonel WM. T. Mc Lyman, Transformer and Inductor Design Handbook, Second Edition and Expanded, Copyright 1988, pp. 35, 36, 37, 38, 44 and 45, by Marcel Dekker, Inc.

*Primary Examiner*—David Hung Vu
(74) *Attorney, Agent, or Firm*—Fay Sharpe LLP

(57) ABSTRACT

Disclosed is a lamp transformer and method of assembling a lamp transformer within an igniter module or housing. The lamp transformer comprises a potted bar core transformer; and a carrier attached to the potted bar core transformer, the carrier adapted to position the potted bar core transformer on a pc board and/or within a housing at a predetermined location. In addition, disclosed is a transformer winding and potting method utilizing a transformer carrier.

24 Claims, 29 Drawing Sheets

U.S. PATENT DOCUMENTS

| | | | | |
|---|---|---|---|---|
| 6,583,585 | B2 | 6/2003 | Takeda et al. | |
| 6,624,596 | B1 | 9/2003 | Ohsawa et al. | |
| 6,641,418 | B2 | 11/2003 | Takahashi et al. | |
| 6,731,076 | B1 | 5/2004 | Gerhard et al. | |
| 6,894,429 | B2 | 5/2005 | Tsuda et al. | |
| 7,042,169 | B2 | 5/2006 | Neumeier et al. | |
| 2004/0125534 | A1 | 7/2004 | Takiguchi et al. | |
| 2010/0026438 | A1* | 2/2010 | Gilmartin et al. | 336/192 |

FOREIGN PATENT DOCUMENTS

| | | | |
|---|---|---|---|
| DE | 100 33 571 | C2 | 1/2002 |
| EP | 0 515 958 | B1 | 3/1995 |
| EP | 0 786 791 | B1 | 11/1999 |
| EP | 1 052 447 | A2 | 11/2000 |
| EP | 1 077 590 | A2 | 2/2001 |
| EP | 0 852 455 | B1 | 5/2002 |
| EP | 0 902 605 | B1 | 6/2003 |
| EP | 0 975 007 | B1 | 1/2004 |
| WO | WO 2004/066686 | A1 | 8/2004 |
| WO | WO 2005/045878 | A2 | 5/2005 |
| WO | WO 2006/027268 | A1 | 3/2006 |

* cited by examiner

LAMP TRANSFORMER

CROSS-REFERENCE TO RELATED PATENTS AND APPLICATIONS

This application is a Continuation-In-Part of U.S. Utility patent application Ser. No. 11/513,777 filed on Aug. 31, 2006 now U.S. Pat. No. 7,760,061 and entitled "LAMP TRANSFORMER," the entirety of which is incorporated herein by reference.

BACKGROUND OF THE INVENTION

This disclosure relates to a high voltage igniter module used to ignite a lamp, for example a HID (High Intensity Discharge) lamp. Specifically, the disclosure relates to a mechanical design of a high voltage transformer and the associated igniter module.

Conventionally, high voltage igniter circuits are used to start HID lamps, such as an automotive lamp or headlight. The igniter circuit typically includes a lead frame or pc board and a transformer where the lead frame carries electrical components to produce a high voltage ignition signal. In addition, the lead frame may provide electrical connection points to power the ignition circuit and deliver the high voltage ignition signal to a HID lamp.

One example of a conventional embodiment of a high voltage igniter circuit includes a lamp receptacle mounted to an igniter circuit lead frame. The igniter circuit transformer is often mounted either directly to the lead frame or separate from the lead frame, and in the latter case, the transformer may be mounted to the lamp housing where the lead frame provides the necessary winding connection points.

High voltage igniter transformers produce the high voltage signals necessary to provide an ignition signal, and generally have a magnetic core, and primary and secondary windings surrounding the magnetic core. As is known, the output voltage associated with the secondary winding is related to the ratio of the number of secondary windings to the number of primary windings.

During the assembly of a HID lamp, it is common practice to pot the transformer with an insulating material to electrically insulate the windings from other electrical components contained within the lamp housing. In addition, potting of the transformer increases the overall stability of the transformer's performance. One drawback associated with potting of the transformer is the necessary step of characterization of the transformer subsequent to potting. Characterization includes testing of the transformer to determine the electrical specifications associated with the transformer.

Conventionally, the characterization of an igniter transformer occurs after the igniter module has been fully assembled. The igniter lead frame carries all electrical components associated with the igniter circuit, including the transformer. Subsequent to the assembly of the lead frame, the transformer is potted, and thus characterization of the transformer is performed with the transformer mounted and potted on the completed lead frame assembly. In the event the characterization of the potted igniter transformer is not within the required specifications, the entire lead frame is discarded or extensive rework is required to remove the potting material to replace the transformer.

Alternatively, the transformer is sometimes mounted within a lamp housing chamber separate from the lead frame, potted therein. The transformer is characterized subsequent to mounting and potting within the lamp housing. In the event the characterization of the igniter transformer is not within the required specification, the housing and transformer assembly are discarded or extensive rework is required to remove the potted transformer from the housing to replace the transformer.

This disclosure provides an igniter module and associated transformer to enable characterization of the transformer prior to the assembly of the transformer within the lamp housing or mounting of the transformer to an igniter lead frame. The disclosed igniter module eliminates the need to discard/rework a lead frame or housing as previously discussed if the characterization of an igniter transformer is determined to be out of specification subsequent to potting.

Other aspects of this disclosure relate to transformer potting apparatuses and methods. Furthermore, methods of winding a transformer core that is integrated with the transformer carriers are disclosed.

BRIEF DESCRIPTION OF THE INVENTION

An exemplary embodiment of a lamp igniter module includes a potted igniter transformer and carrier; a carrier attached to the potted igniter transformer; a lead frame on which the potted igniter transformer is mounted; and a housing for receiving the lead frame and the potted igniter transformer and carrier; wherein said carrier is adapted to position the potted igniter transformer and carrier in a predetermined position in relation to one or both of the lead frame and the housing.

Means for positioning the potted igniter transformer and carrier relative to one or both of the lead frame and housing may be included. The igniter transformer includes a cylindrically, rectangularly or other polygonal shaped rod core and a plurality of windings along the length of the core. Margin tape maybe used to define the extent of the windings along the length of the core, and likewise define the extent of the potting along the length of the transformer. Similarly, the carrier comprises first and second end parts which form bobbin walls to define the extent of windings along the length of the core, or form potting walls to define the extent of the potting along the length of the transformer. The end parts may each have one or more locator pins for positioning a potted igniter transformer and carrier on the lead frame. In another embodiment, a housing includes one or more locator features for positioning a potted igniter transformer and carrier in a predetermined position in relation to the housing.

A method of assembling a lamp module includes the steps of mounting a carrier comprising a first end piece and a second end piece to the respective first and second ends of the core of a transformer, and winding primary and secondary windings around the core before or after mounting the said carrier first and second pieces; positioning the transformer with the carrier into a potting mold; potting the transformer; mounting the potted transformer in a predetermined position on an igniter lead frame; and positioning the igniter lead frame in a housing

DETAILED DESCRIPTION OF THE INVENTION

A high voltage transformer and an associated igniter module for a gas discharge lamp finds particular application in an automotive lamp product, although one of ordinary skill in the art will appreciate that the teachings herein may have application in related products. The modular design comprises a lead frame or printed circuit board (PCB) including low voltage electronic components and a high voltage core transformer substantially covered in a high voltage, insulative potting material. The high voltage core transformer is mounted on the lead frame by means of a carrier. Notably, for purposes of this disclosure, low voltage refers to voltages equal to or less than approximately 1 kV and high voltage refers to voltages greater than approximately 1 kV, for example 30 kV. However, this disclosure is not limited to these specific voltages.

Potting of the high voltage core transformer may be completed before or after the transformer is attached to the lead frame. Pre-potting of the transformer before attachment to the lead frame provides an opportunity to discard a potted high voltage core transformer without discarding the entire lead frame or associated housing in the event the characterization of the potted core transformer is not within acceptable tolerances. In other words, the required characterization of the potted high voltage transformer is performed before the transformer is attached to the PCB. This design (and embodiments thereof) is distinguishable from the prior art which requires potting of an igniter module high voltage transform after the transformer is attached to an igniter lead frame or mounted within an igniter module chamber. As discussed in the background section of this disclosure, characterization of the high voltage transformer thus occurs subsequent to potting of the transformer in the prior art arrangements. Accordingly, the prior art ignition module requires a potted lead frame with an attached transformer or lamp housing with a potted transformer to be discarded in the event the characterization of the transformer is not within acceptable tolerances.

Figure 1:
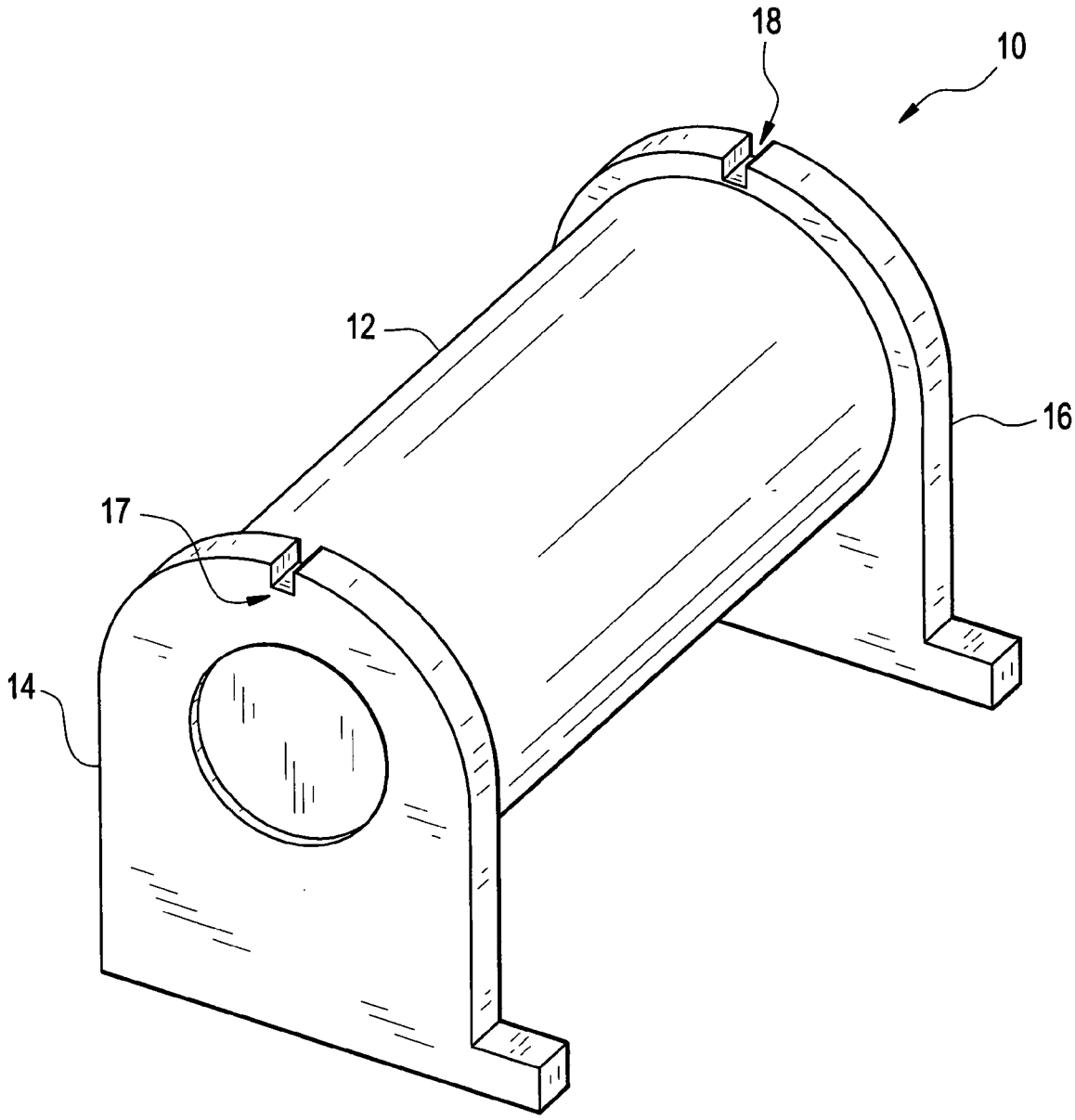
FIG. 1 illustrates a lamp igniter transformer according to an exemplary embodiment of this disclosure.

With reference to FIG. 1, a potted bar core transformer assembly 10 according to an exemplary embodiment of this disclosure is shown. The transformer assembly 10 includes a potted core transformer 12, a first carrier end part or carrier component 14, and a second carrier end part or carrier component 16. The carrier end parts preferably include locator features such as slots 17 and 18 which provide means for positioning the potted bar core transformer assembly within a housing (see FIG. 3) and as will become more apparent from the following discussion.

In one exemplary embodiment, the bar core transformer includes a rod shaped core. For purposes of this disclosure, the term "rod shaped core" refers to, but is not limited to, a cylindrical shaped or a rectangular shaped core. However, other core shapes are within the scope of this disclosure, and may include, for example, substantially cylindrical, square, and three or more longitudinal faces producing a triangular, pentagonal, hexagonal, or other polygonal cross sectional area. The carrier end parts 14 and 16 are desirably made of a high temperature plastic, for example, PPS or ULTEM, although similar materials of construction providing similar benefits are contemplated. The carrier end parts 14 and 16 serve at least three basic functions when attached to the longitudinal ends of the core material. The carrier ends function as bobbin walls to efficiently wind the transformer core using a maximum length of the core, i.e., the carrier ends/bobbin walls define the extent of the windings along the length of the core. In addition, the carrier end parts 14 and 16 function as supports for an insulating potting material deposited between a mold and the carrier end part, the mold holding the transformer potting material while it is curing. That is, the carrier end parts form potting walls to define the extent of the potting along the length of the transformer. Also, the carrier end parts 14 and 16 function as positioners of the potted bar core transformer in relation to one or both of the lead frame/pc board and the housing (see FIG. 3). Particularly, locator pins 56 (FIG. 3) cooperate with locator tabs, and/or locator slots (for example, slots 17, 18) as will become more apparent from the below description of one or more preferred arrangements.

The transformer illustrated in FIG. 1 is potted after the transformer winding process by casting the wound transformer in a lined mold. Subsequent to the curing of the potting material, a full characterization and testing of the potted bar core transformer 10 is completed. Notably, this characterization and testing of the potted bar core transformer 10 can occur prior to any further assembly of the igniter module, thereby avoiding discardment and/or rework of a more complete igniter module assembly in the event the potted bar core transformer does not meet tolerances related to the said characterization and testing.

Figure 2A:
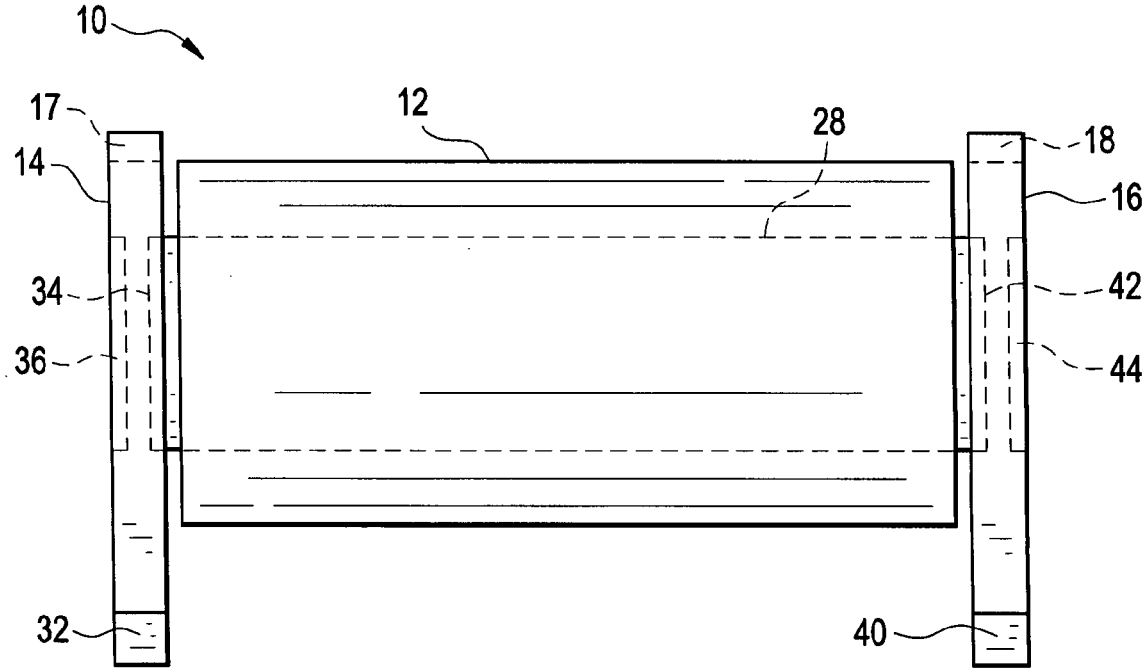
FIG. 2A and FIG. 2B are front and side views, respectively, of the lamp igniter transformer illustrated in FIG. 1.
Figure 2B:
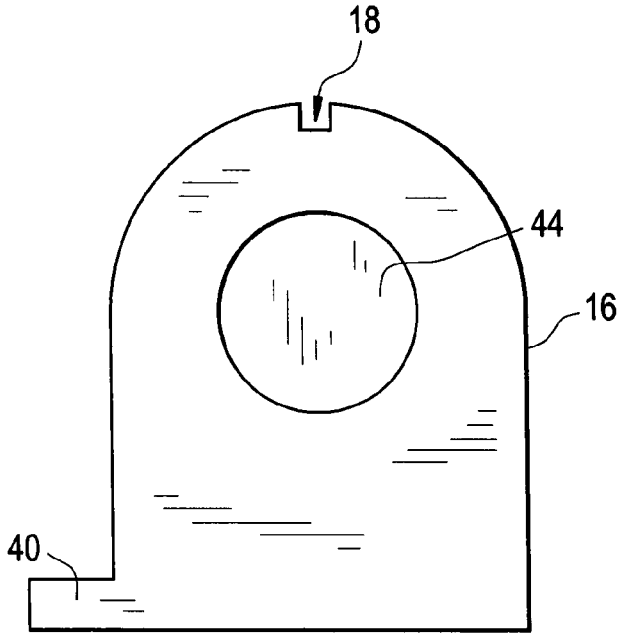

With reference to FIG. 2A and FIG. 2B potted bar core transformer assembly 10 includes a potted bar core transformer 12, a first carrier end part 14 and a second carrier end part 16 disposed at opposite axial ends of transformer core 28. The first carrier end part 14 has a carrier end part slot 17 extending inwardly from a peripheral wall portion thereof, a carrier end part tab 32 that extends tangentially outward from a base portion of the carrier end part, an inner recess 34 extending inwardly from a first or inner face of the carrier end part, and an outer recess 36 extending inwardly from a second or outer face of the carrier end part. The recesses 34, 36 are shown as being of the same dimension and are also circular in one arrangement, although other conformations. Similarly, the second carrier end part 16 is a mirror image of the first carrier end part 14 for ease of construction, inventory, and assembly, although this disclosure should not be unduly limited to the particular configurations shown and described herein. Thus, the second carrier end part has a carrier end part slot 18, a carrier end part tab 40, an inner recess 42 and an outer recess 44. The carrier inner recesses 34, 42 are dimensioned to receive or attach to opposite longitudinal ends of the transformer core 28, for example by means of a press fit or adhesive. Notably, the carrier outer recesses 36 and 44 enable the same carrier end part to be used at either end of the transformer core 28 so that inadvertent interchangeability of one end part for another does not impact assembly.

Figure 3:
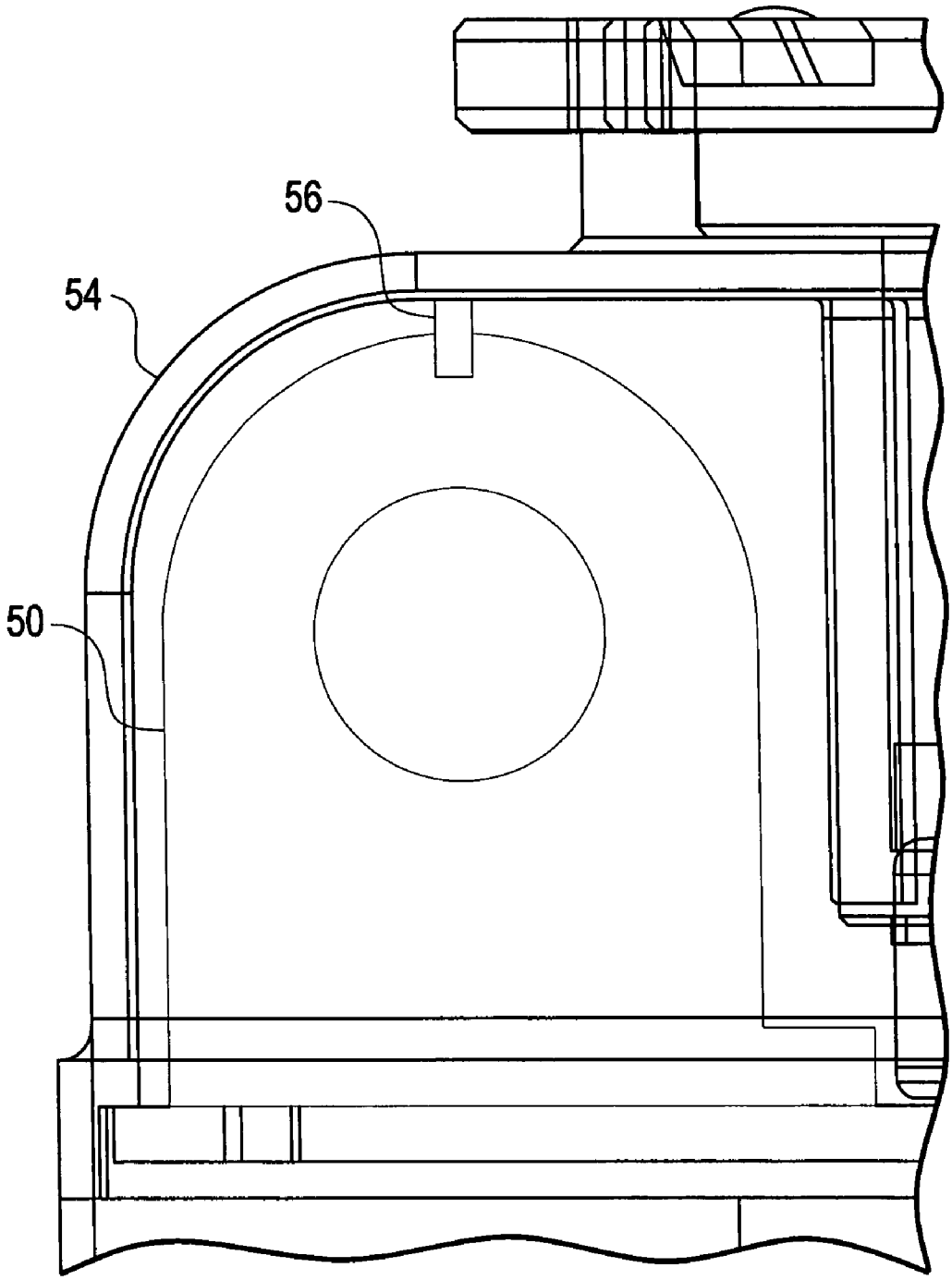
FIG. 3 show a front view of the lamp igniter transformer illustrated in FIG. 1 positioned within a housing.

A bar core transformer assembly 10 is shown mounted within a housing 54 in FIG. 3. The housing 54 preferably has a housing locator tab 56 extending into an interior cavity of the housing so as to mate with the carrier end part identified here by reference numeral 14 that has a slot 17. This mating arrangement assures desired final positioning of the transformer assembly 10 within and relative to the housing 54.

Figure 4A:
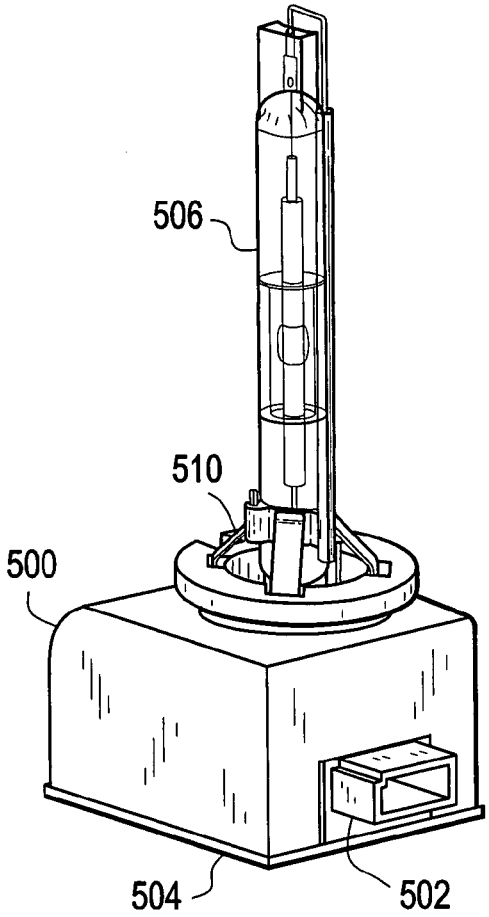
FIGS. 4A and 4B illustrate a lamp igniter module assembly.
Figure 4B:
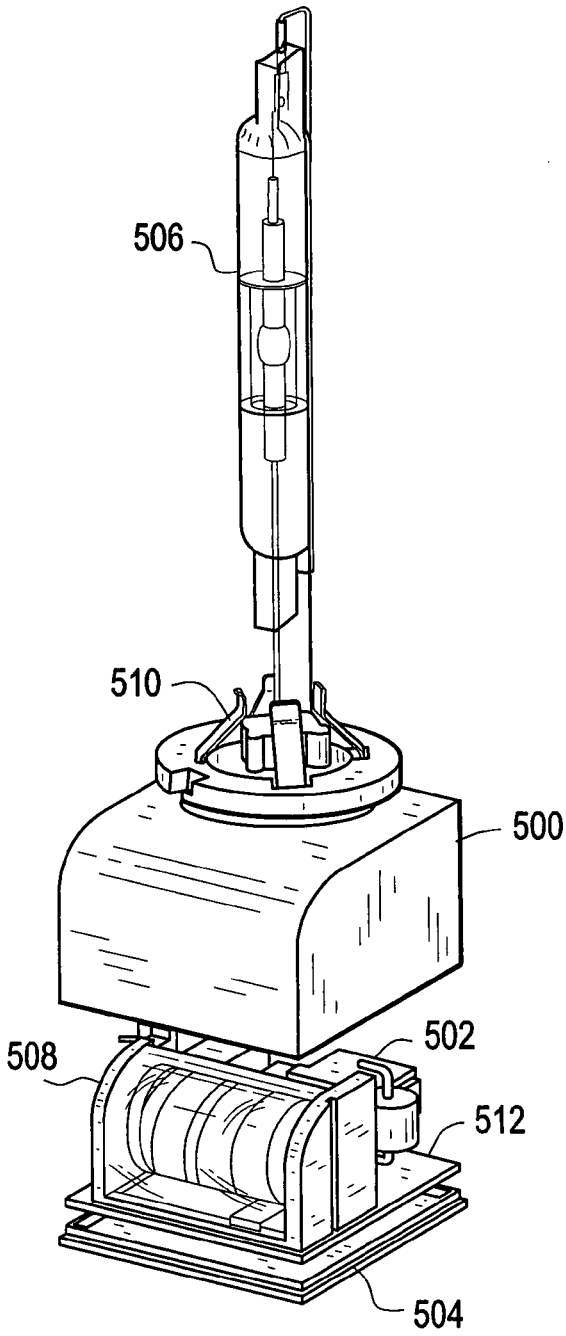

Incorporation of a transformer and housing as described to this point into a lamp igniter module assembly is shown in FIGS. 4A and 4B. More particularly the lamp igniter module assembly includes a housing 500 conformed to overlie or cover, an electrical connector such as female connector 502, a housing bottom cover or base 504, and a lamp 506 such as a high intensity discharge lamp often used as a headlamp. The lamp receiver preferably includes flexible fingers such as metal fingers 510 (shown here as four circumferentially spaced fingers) that extend outwardly from the housing for mechanically clamping about an external peripheral end portion of the lamp 506. Inside the housing is a lead frame or pc board 512 that is secured to the transformer assembly and the electrical connector. Lamp leads extend from the lamp and are routed or threaded through the top of the housing near a central portion thereof and electrically connected to the lead frame/pc board and transformer within the housing. The bottom cover 504 is secured to the remainder of the housing, for example, the perimeter of the bottom cover is fused, welded, or adhesively secured the housing to seal the lamp igniter module to complete the assembly as shown in FIG. 4A. Power is provided to the lamp igniter module assembly through a mating electrical connector (e.g., male, plug-type electrical connector) received in the connector 512.

Figure 5A:
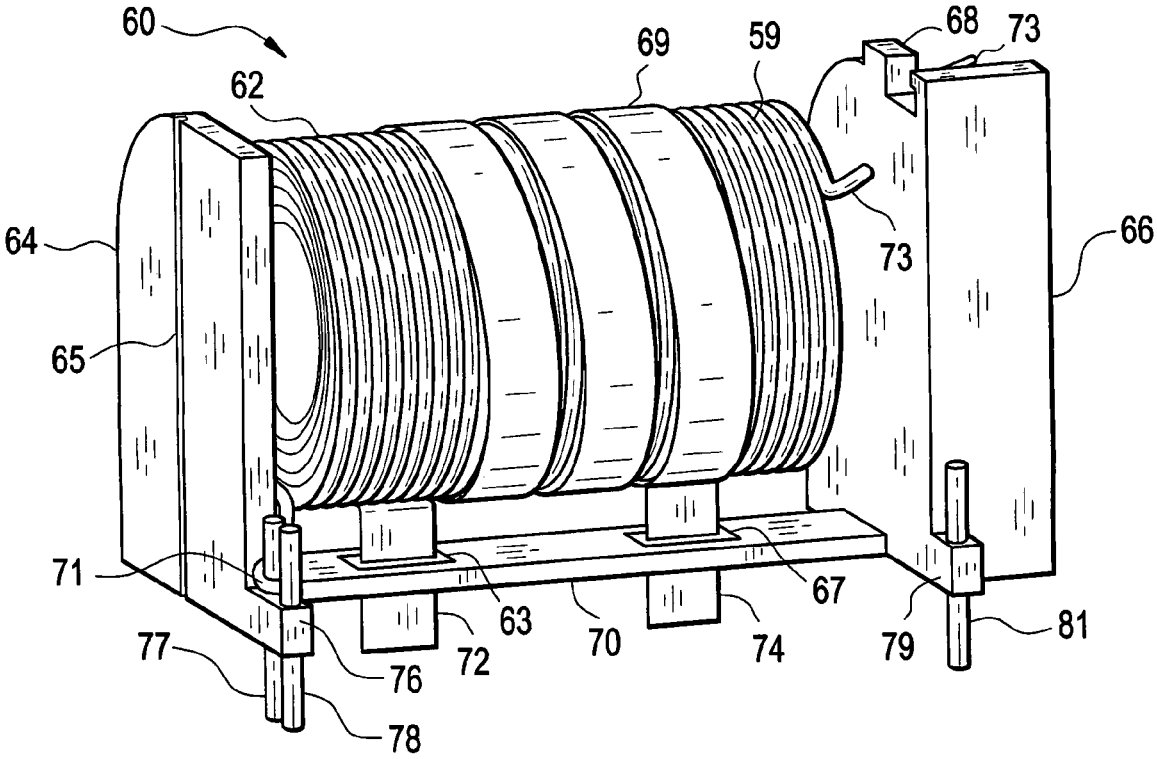
FIGS. 5A through 5I show a lamp igniter transformer and method of assembling a lamp igniter module.

FIGS. 5A through 5I illustrate an alternate embodiment of a lamp igniter transformer and method of assembling a lamp igniter module according to an exemplary embodiment of this disclosure. Initially referring to FIG. 5A, a transformer carrier 64 includes a locator slot or groove 65 to position the transformer assembly within a housing. In addition to the locator slot 65 located on the first carrier end part, the second carrier end part may include a locator slot or feature too (not shown). Other positioning means associated with the carrier end parts include a carrier locator tab 68 which engages or mates with a lamp module housing comprising a mating slot, groove, or channel. The rod core transformer assembly of FIG. 5A represents the initial stage 60 of assembly of the igniter module. The rod core transformer assembly has a rod core transformer 62 including a secondary 59 and primary 69 windings, a first carrier end part 64, a second carrier end part 66 axially spaced at opposite ends of the transformer 62, and a lead guide bridge 70 that is mounted between the first and second carrier end parts in generally parallel relation to the axis of the transformer. The first carrier end part 64 includes a carrier locator pin tab 76, attached carrier locator pins 77 and 78 extending through and outwardly from the pin tab 76. Similarly, the second carrier end part 66 comprises a carrier locator pin tab 79, an attached carrier locator pin 81 having a portion extending outwardly from the tab for receipt in a lead frame as will be described further below, and a locator tab 68. In addition to providing means for attachment of the carrier end parts to the lead frame/PCB in a subsequent assembly step, the carrier locator pins can provide electrical connection points for winding lead wires associated with the transformer, if desired. For example, a rod core transformer assembly without a lead guide bridge 70 can be configured to electrically connect the primary winding lead wires 72 and 74 to two separate metal locator pins, such as locator pins 78 and 81. The secondary winding lead wires 71 and 73 can be connected to a third and fourth locator pins, respectively, and/or alternatively through a lead hole(s) provided on one or both of the carrier end parts 64, 66. Notably, this disclosure is not limited to a particular configuration of the carrier locator pins or carrier feed through holes associated with electrically connecting the transformer windings to a lead frame/PCB or other connection point even though, the exemplary embodiment illustrated in FIGS. 5A through 5I routes the primary winding leads 72 and 74 through lead guide bridge openings 63 and 67, respectively, which position the lead guides for connection to a pc board. The secondary winding or low voltage lead 71 is electrically connected to carrier lead guide 77 and the secondary high voltage lead 73 is routed through a carrier end part lead hole 61.

Figure 5B:
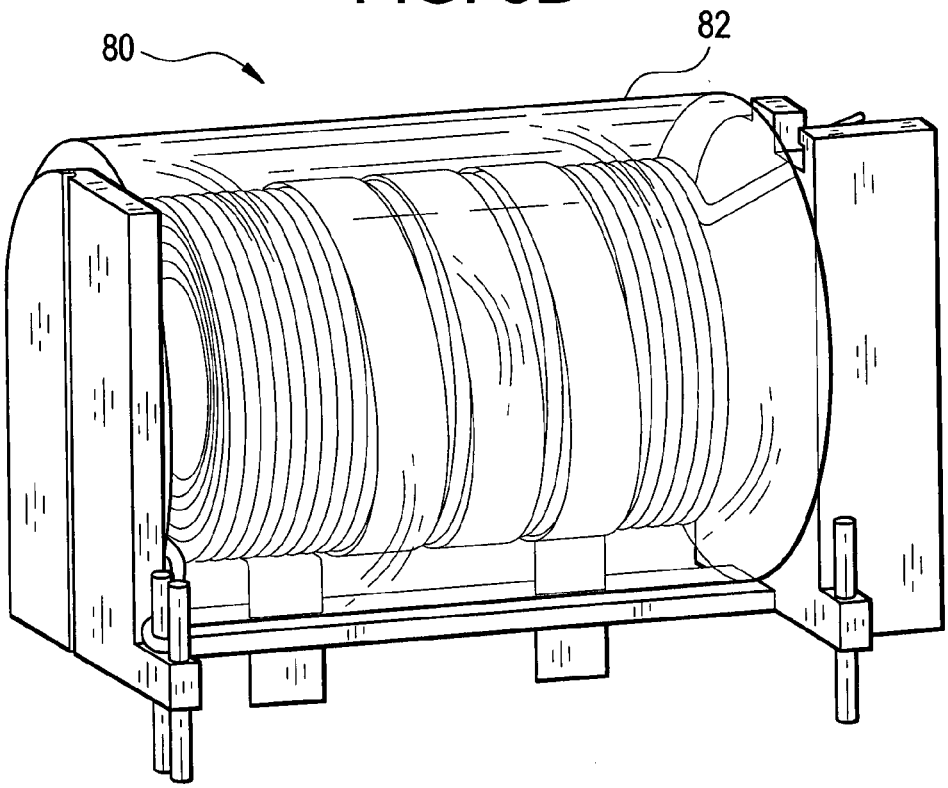
Figure 5C:
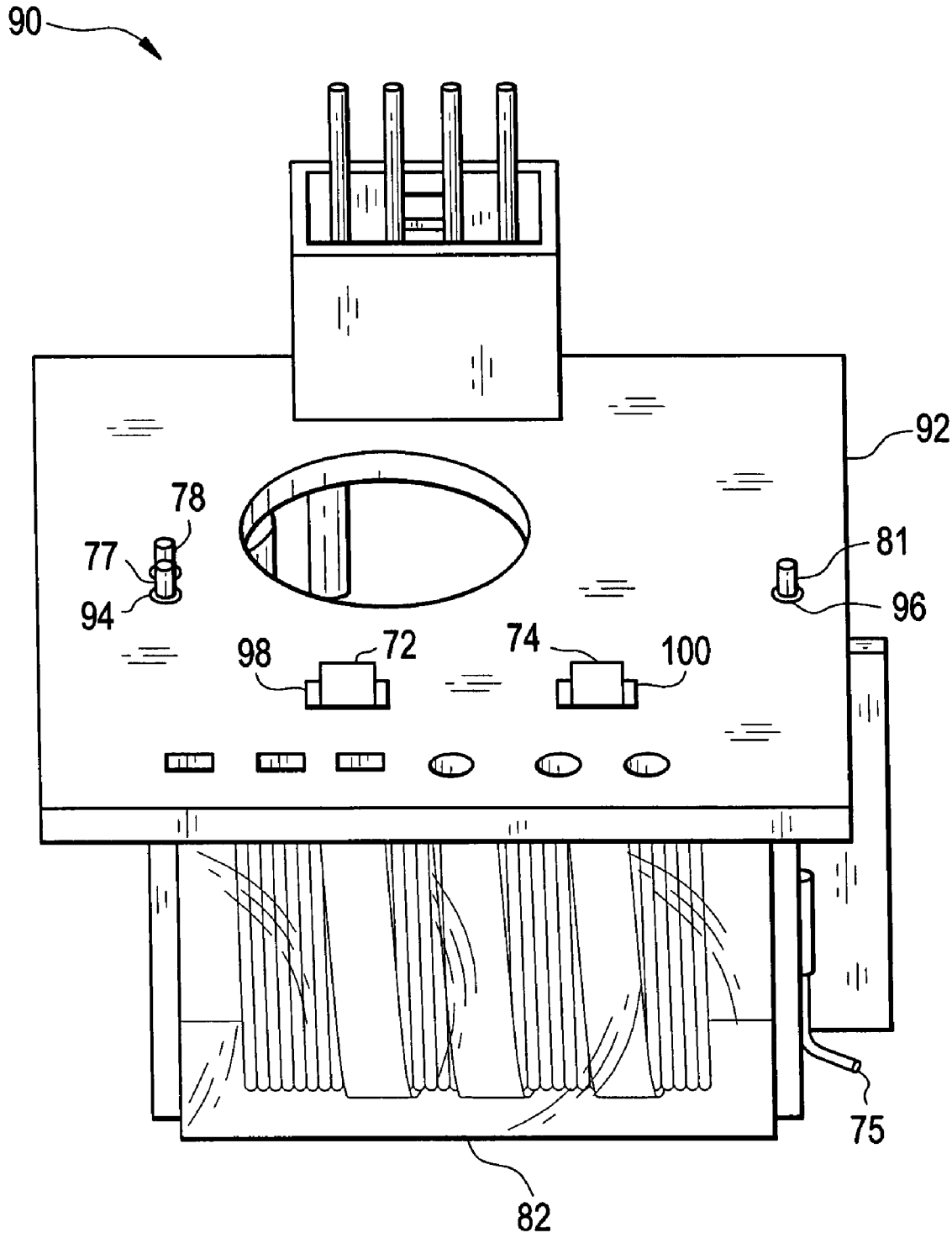

FIG. 5B illustrates a second step 80 of assembling the igniter module; namely potting the transformer core and windings with an insulating potting material 82, for example a silicone or epoxy material. Notably, carrier end parts 66 and 68 provide potting walls defining the extent of potting along the length of the transformer.

A third step 90 of assembling the igniter module includes electrically connecting, for example, by means of soldering to the lead frame/PCB 92, the potted transformer leads 72 and 74 after routing the leads through transformer lead guide openings or holes 98 and 100. In addition, the potted core transformer 82 and carriers are attached to the PCB at the PCB carrier locator pin receivers 94, 77 and 96, for example, by means of soldering the respective locator pins 77, 78 and 81 to the PCB.

Figure 5D:
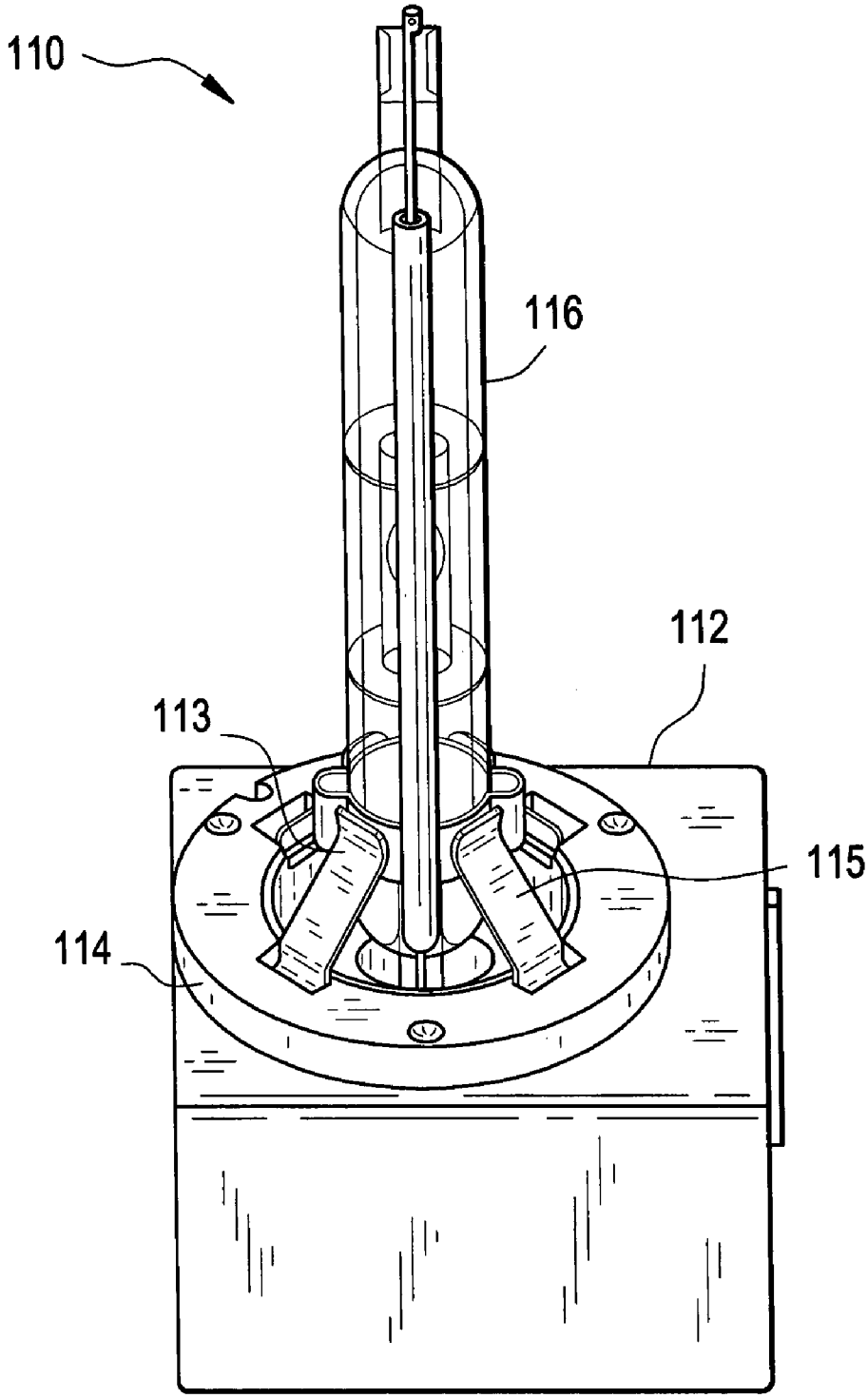

In a fourth step 110 of assembling the igniter module, a lamp 116 is inserted into the lamp receptacle 114 that is attached to a housing 112. The lamp leads (not shown) are advanced or threaded into the housing. The lamp is fixed to the lamp receptacle by welding the lamp a surrounding strap fingers 113, 115, as illustrated in FIG. 5D.

Figure 5E:
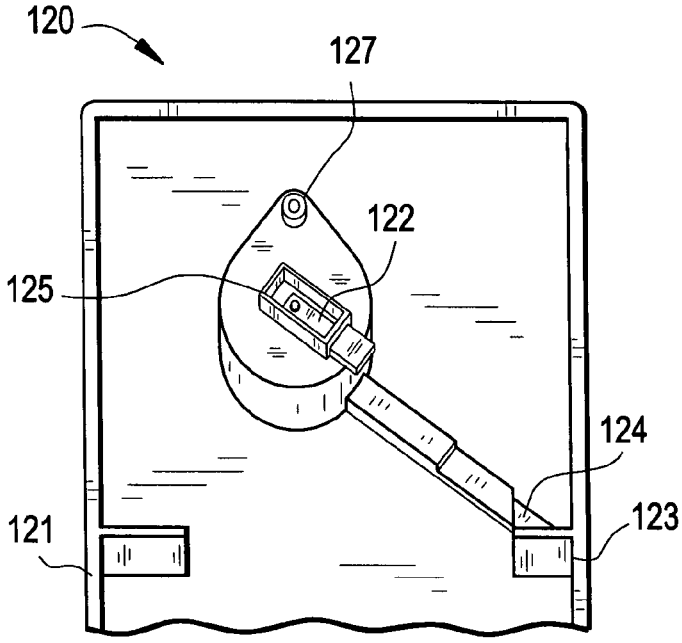

As shown in FIG. 5E, a first lamp lead which was previously threaded through lead through hole 125 is electrically connected to a metal strip 122 located on the inside of the housing. Notably, a metal strip connection point 124 is provided to subsequently connect the high voltage secondary lead of the transformer. Connection of the lamp lead may include laser welding, soldering or other conventional means for electrically connecting an electrical lead and metal strip. Also, lead guide hole 127 provides isolation and routing of the lamp second lead to the pc board.

Figure 5F:
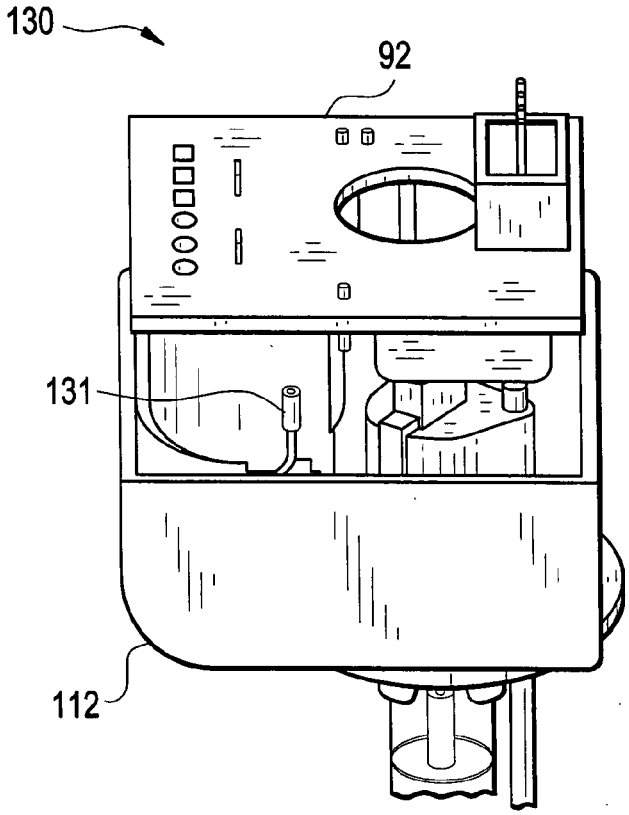

With reference to FIG. 5F, illustrated is step six 130 of assembling the igniter module which comprises inserting the completed PCB 92 into the housing 112 and electrically connecting the second lamp lead (not shown) associated with lead guide hole 127, as illustrated in FIG. 5E to the lead frame or PCB. The PCB is positioned and attached within the housing by means of the engagement tabs 121, 123 illustrated in FIG. 5E.

Figure 5G:
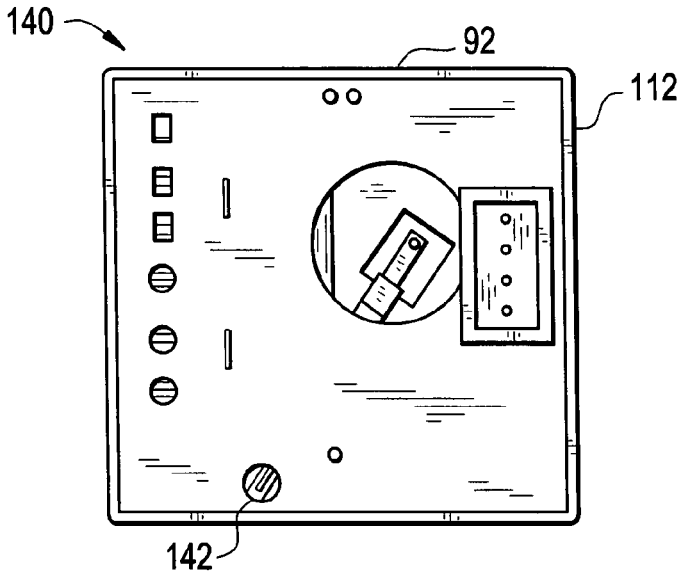

A seventh step 140 of assembling the igniter module includes electrically connecting the high voltage secondary winding lead of the potted transformer to electrical connection point 124 illustrated in FIG. 5G by way of an access hole 142.

Figure 5H:
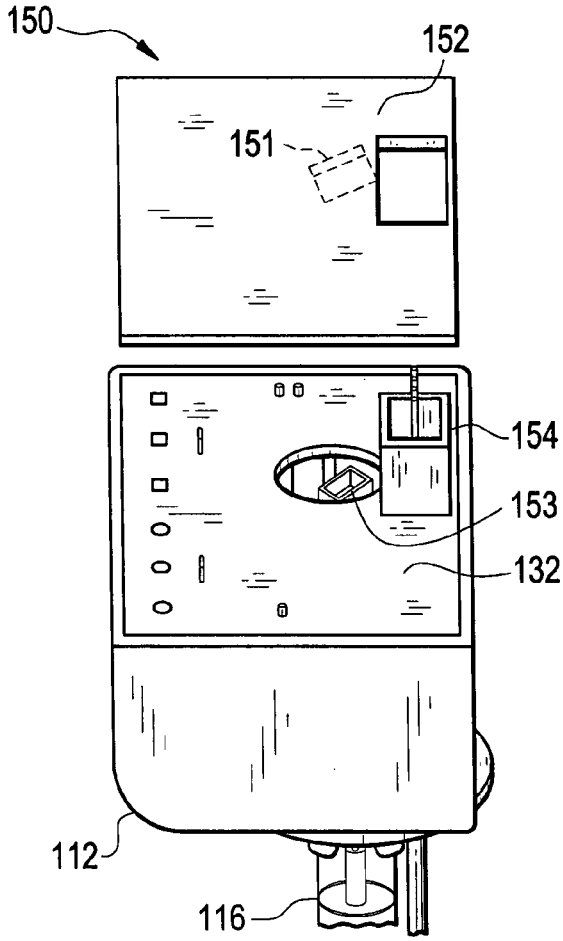

In FIG. 5H, a subsequent step or step eight 150 of assembling the igniter module includes locating a bottom cover 152 over the PCB 132 connector 154 and attaching the said bottom cover 152. As previously noted, the bottom cover may be secured with adhesive, ultrasonically welded or attached via other mechanical means. The cover includes a high voltage connection enclosure cover 151 which mates with a high voltage connection enclosure base 153 when the bottom cover is secured in position.

Figure 5I:
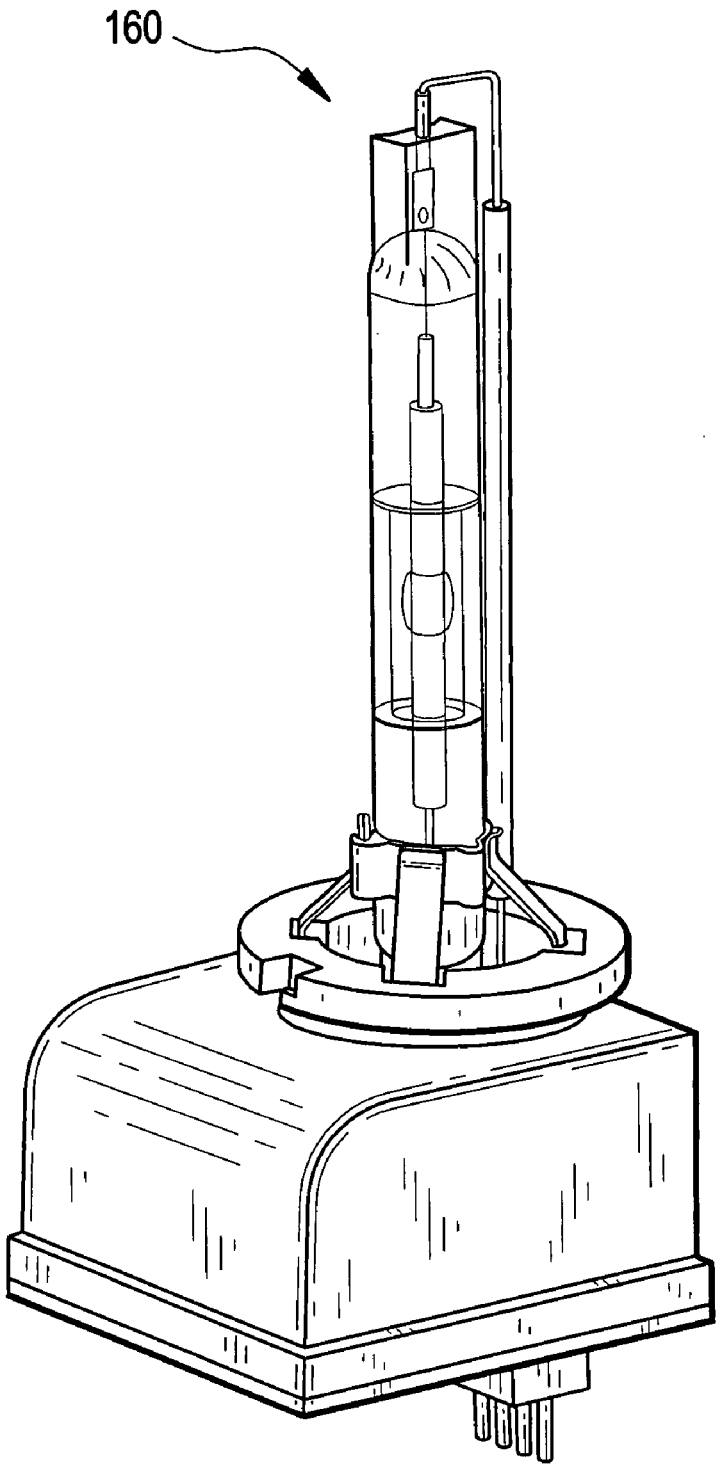

The assembled igniter module is shown in FIG. 5I in perspective view.

Figure 6A:
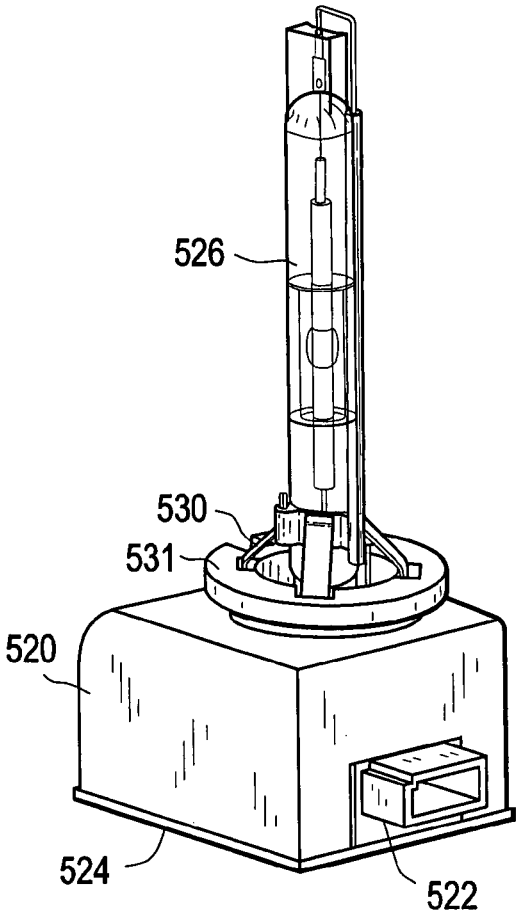
FIGS. 6A and 6B show another a lamp igniter module assembly.
Figure 6B:
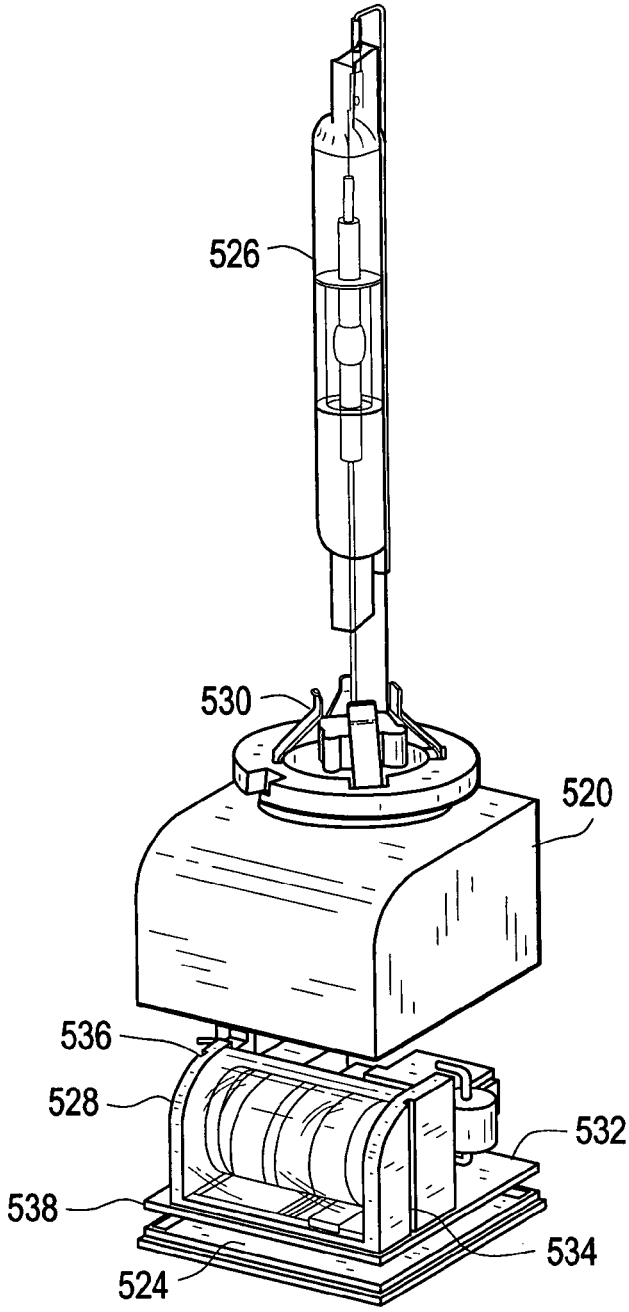

FIGS. 6A and 6B illustrate another preferred embodiment of an igniter module assembly. Particularly, the lamp igniter module has a housing 520 that includes an electrical connector 522 opening outwardly therefrom. Housing bottom cover 524, lamp receiver 530, lamp receiver base 531, and lamp 526 are similar to the arrangements described above unless noted otherwise. Inside the housing 520 is a pc board 532 comprising a transformer and carrier 528. Notably, the igniter module is similar to the lamp igniter module discussed with reference to FIGS. 4A and 4B, except the transformer carrier 528 includes vertical locator features or slots 534, 536 molded in the carrier ends 528. The locator slots 534, 536 mate with the locator tabs molded within the housing 520 to provide desired positioning of the pc board at a predetermined position within the housing 520. In addition, the transformer carrier includes a lead guide 538 to route and position the transformer primary winding leads in relation to the pc board for electrical connection.

Figure 7A:
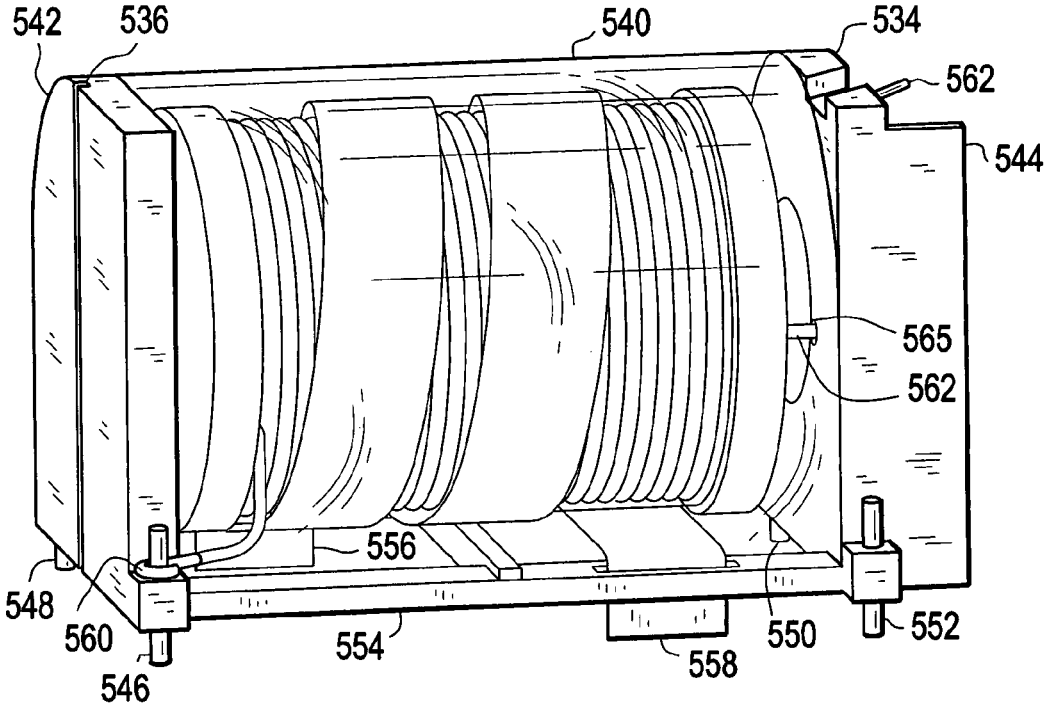
FIGS. 7A through 7E illustrate another embodiment of a lamp igniter transformer and method of assembling a lamp igniter module.
Figure 7B:
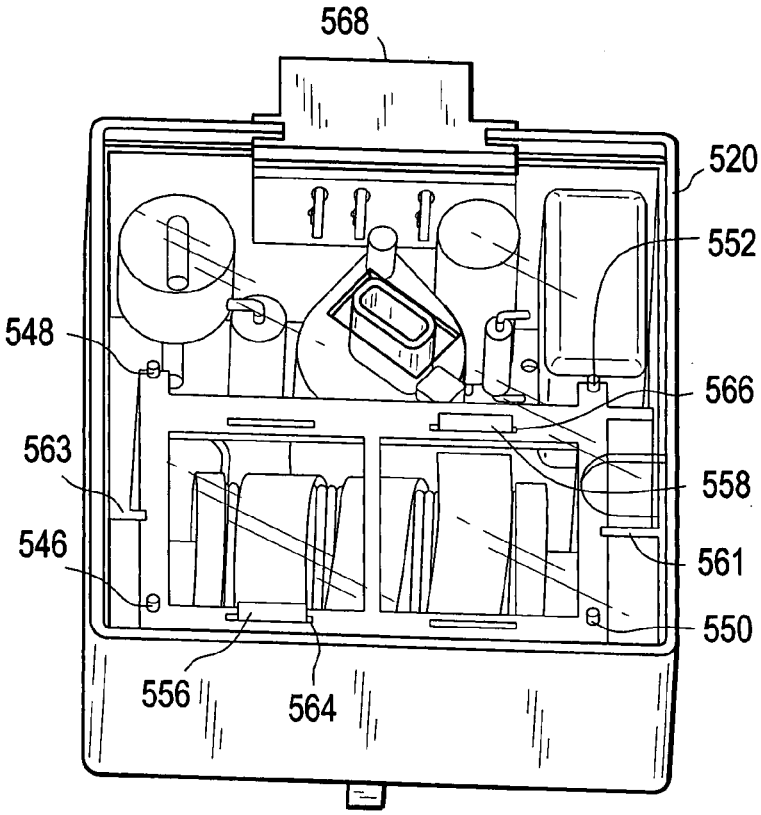

FIGS. 7A through 7E illustrate a sequence of assembly steps for a lamp igniter module as shown and described in connection with FIGS. 6A and 6B. As illustrated in FIGS. 7A and 7B, the initial steps comprise the placement of a transformer assembly within a lamp housing. The transformer assembly comprises a potted transformer 54 a carrier—including a first end piece 542 and a second end piece 544 disposed at opposite axial ends of the transformer, and a lead guide bridge 554 spanning between the first and second end pieces. In addition, the carrier end pieces include locator pins 546, 548, 550 and 552 that aid in positioning the carrier and associated transformer relative to a pc board. The lead guide bridge 554 extends from the first carrier end piece 542 to the second carrier end piece 544 and has lead guide holes or slots 564 and 566 which are shown in FIG. 7B. The primary winding leads 556 and 558 are routed or threaded through lead guides 564 and 566, respectively, to position the leads for connection to a subsequently attached pc board. The transformer secondary winding lead 560 is soldered to metal guide post 546 and the transformer secondary winding lead 562 is routed through a carrier end piece guide hole 565.

In FIG. 7B, the housing 520 includes carrier locator tabs 561 and 563 to engage or mate with carrier locator slots 534 and 536, respectively, to position the transformer within the lamp housing at a predetermined location.

Figure 7C:
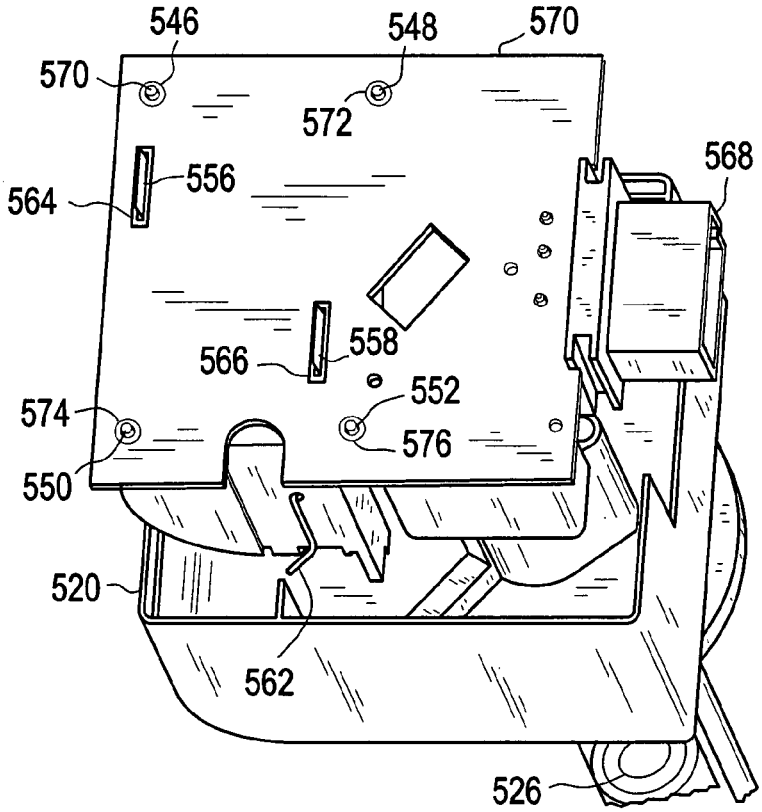
Figure 7D:
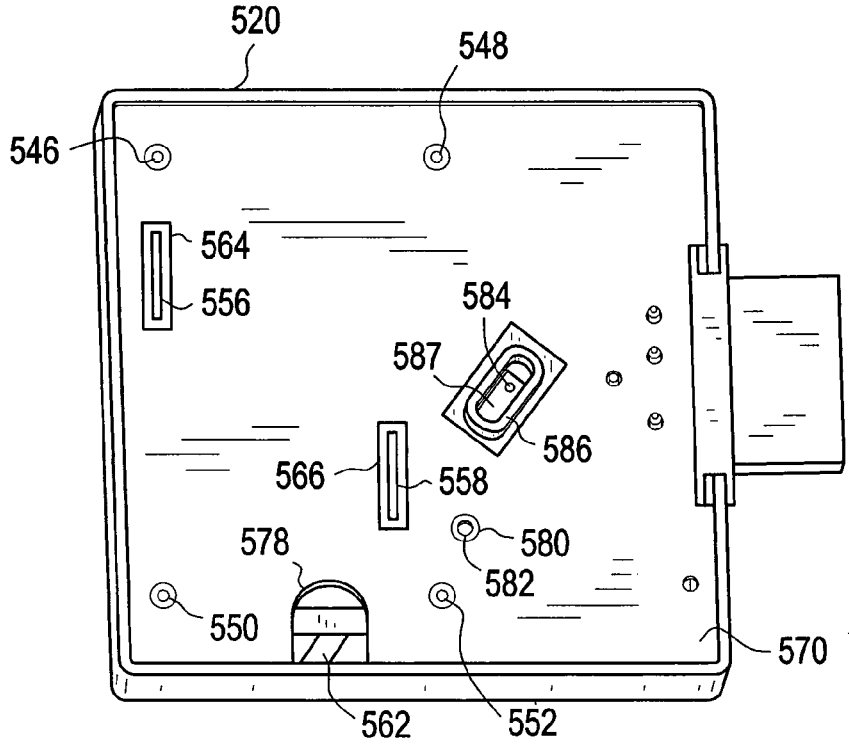

As shown in FIGS. 7C and 7D, pc board 570 is installed within the igniter module housing 520. Preferably a slide-in connecter 568 is attached to the pc board 570 prior to placement of the pc board 570 within the igniter module housing. That is, the connector is preferably secured to an edge of the pc board, and inwardly extending grooves at opposite edges of the connector cooperatively receive walls defining a recess in a sidewall of the housing to interlock the connector and pc board to the housing. As illustrated, the primary winding leads 556 and 558 are routed or threaded through pc board lead guide holes 564 and 566, respectively. The transformer carrier guide posts 546, 548, 550, 552 are aligned and extend through pc board lead guide holes 570, 572, 574, 576, respectively.

The final placement of the pc board 570 within the igniter module housing 520 is illustrated in FIG. 7. A first lamp lead 582 extends through pc board lead guide hole 580 and a second lamp lead 584 extends through a lead guide hole within a high voltage connection enclosure base 584 located on the inside of the module housing 520. The lamp lead 584 is electrically connected to a metal plate 587 by means of soldering or welding. With regard to other electrical/mechanical connections performed, lead posts 546, 548, 550 and 552, and primary winding leads 556 and 558 are soldered, welded, i.e., electrically connected to pc board metal pads, tracks and/or plates. Electrically connecting the high voltage secondary winding lead 562 to the lamp high voltage lead 584 is accomplished by soldering or welding the high voltage secondary winding lead 562 to a metal track/plate accessible through a pc board access hole 578. The track/plate is integrated with the inside face of the igniter module housing and electrically connected to the lamp connection plate 587 by means of a metal track. Further details regarding this high voltage electrical connection are discussed below with reference to FIGS. 10A through 10C.

Figure 7E:
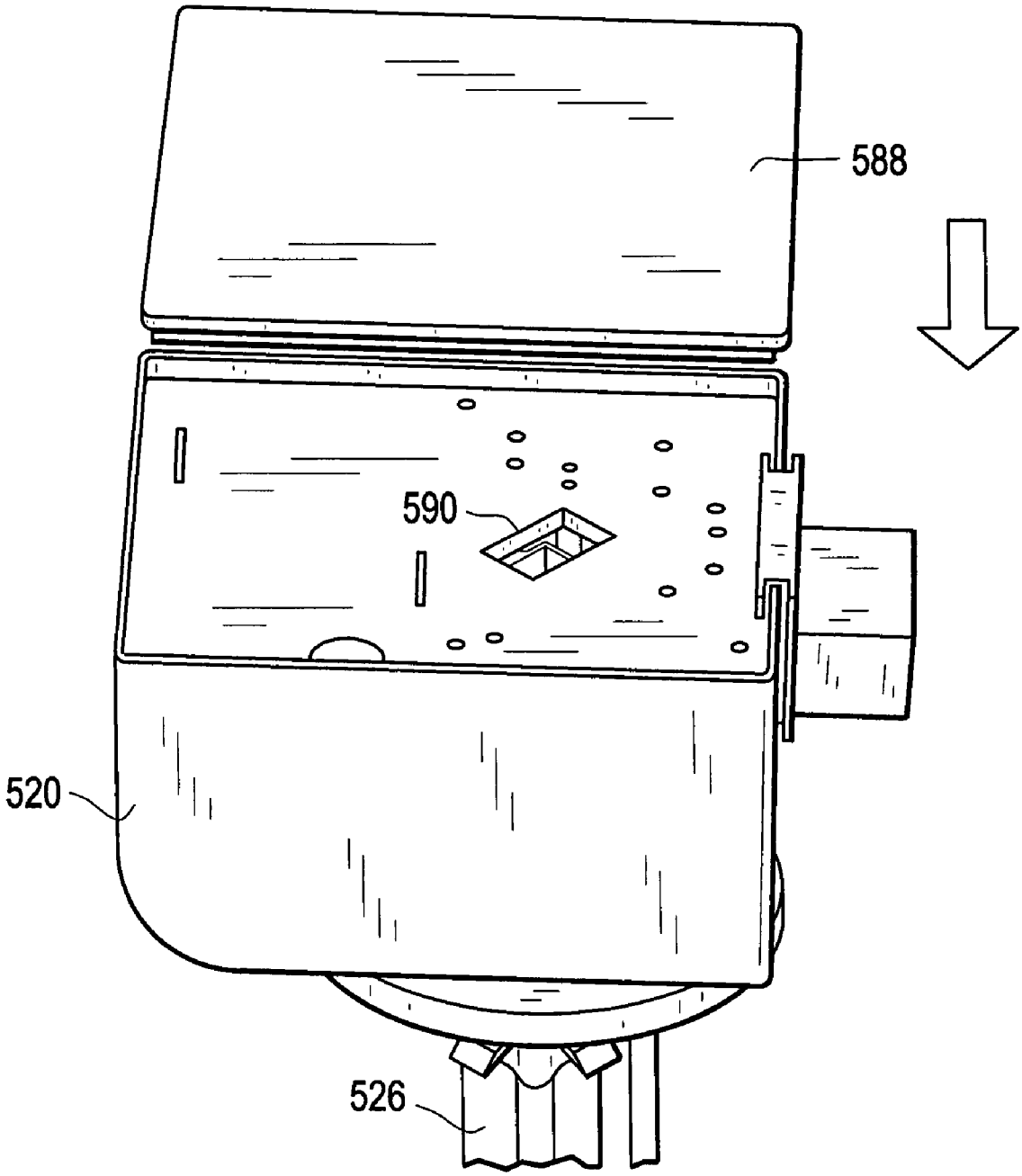

In FIG. 7E, a housing bottom cover 588 is positioned on the housing face opposite the lamp. The housing bottom cover 588 is adhesively secured, ultrasonically welded, or otherwise suitably attached by some other means to complete the lamp igniter module assembly as illustrated in FIGS. 6A and 6B.

Figure 8A:
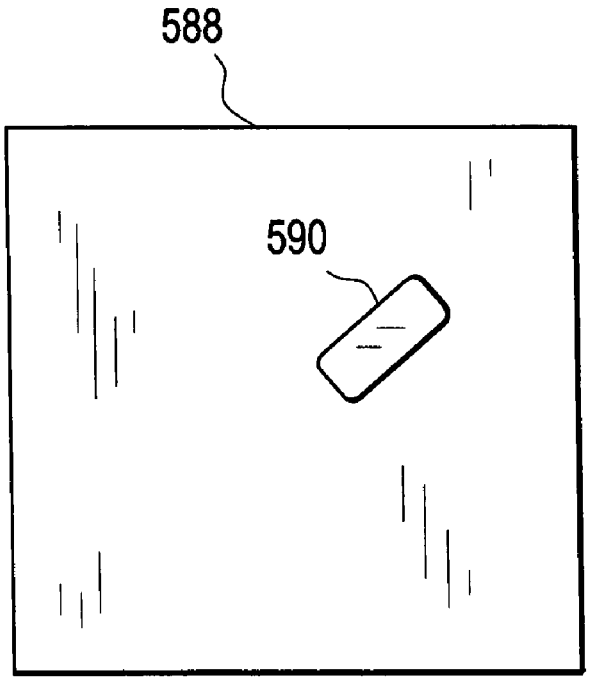
FIGS. 8A and 8B are bottom and side views of a lamp igniter transformer module cover.
Figure 8B:
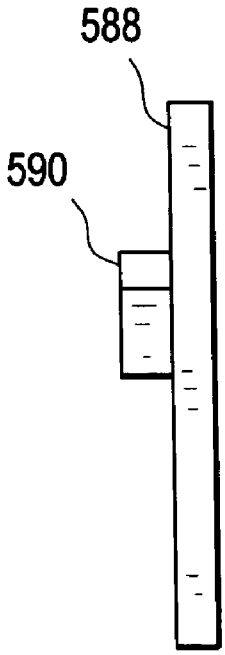
Figure 9:
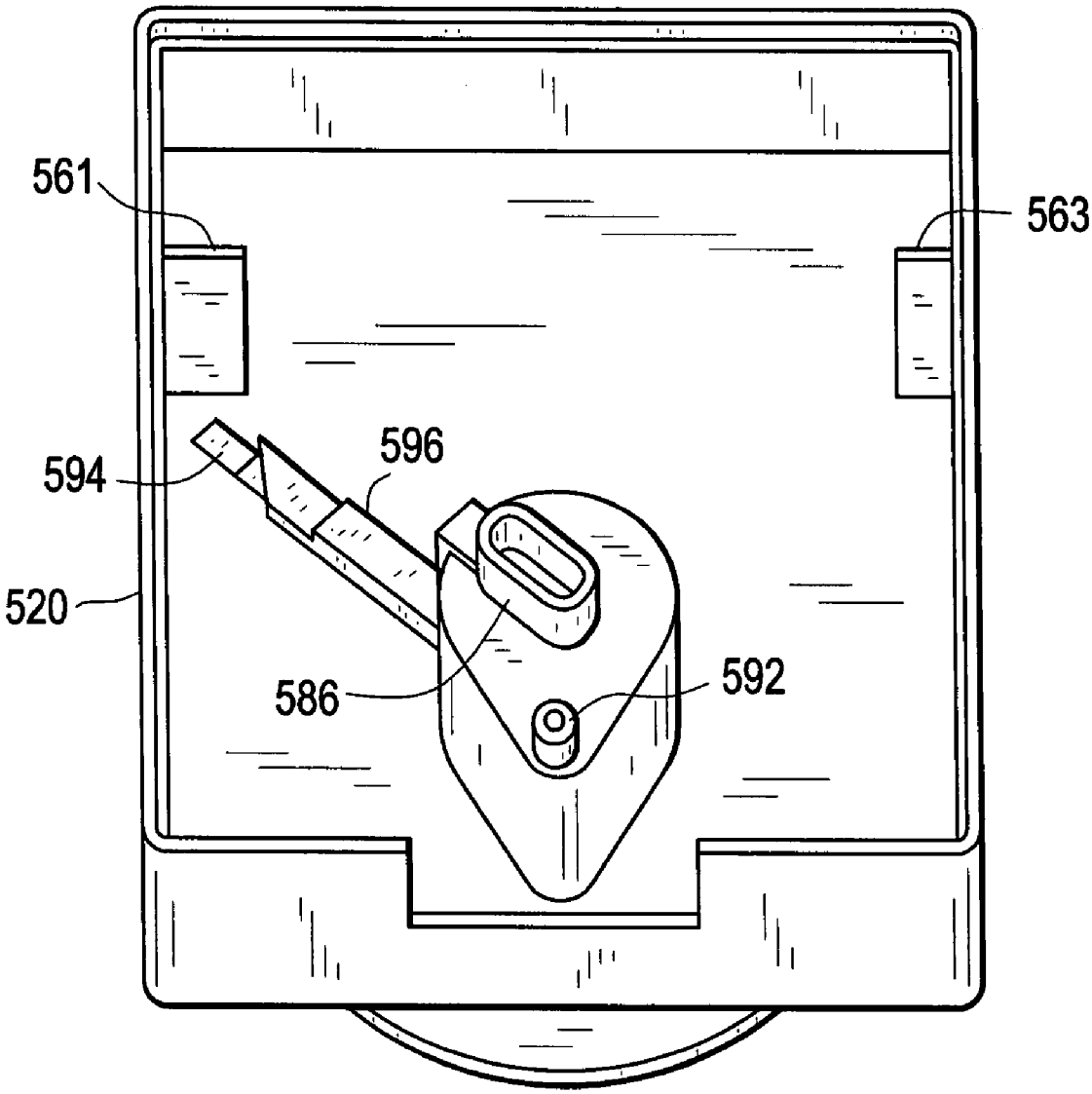
FIG. 9 show yet another embodiment of a lamp igniter transformer module housing.

With regard to the bottom cover 588, FIGS. 8A and 8B illustrate the details of a high voltage connection cover 590 which covers the lamp connection plate 587 within the high voltage connection enclosure base 586 as illustrated in FIG. 9 and briefly described with reference to FIG. 7D. Moreover, FIG. 9 illustrates other features of the igniter module housing 520 including locator tabs 561 and 563, lamp lead guide 592, a conductive track 596 which runs from the secondary winding high voltage connection plate 594 to a lamp lead connection plate 587 located within the connection enclosure base 586, and lamp lead guide 592.

Figure 10A:
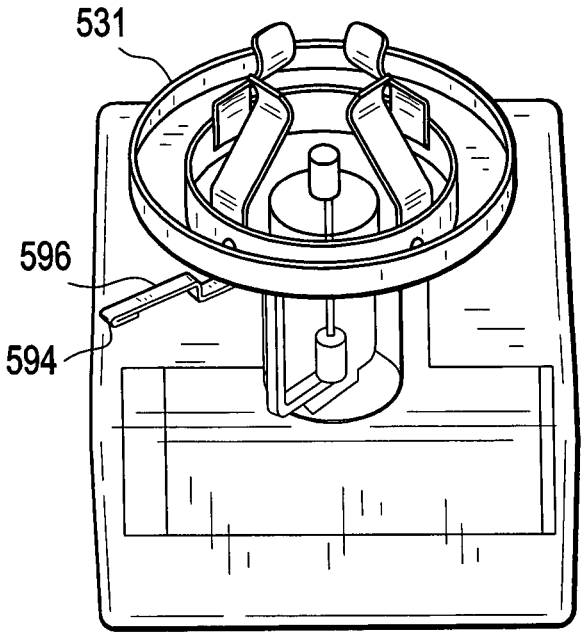
FIGS. 10A through 10C are detail views of a lamp igniter transformer module housing.
Figure 10B:
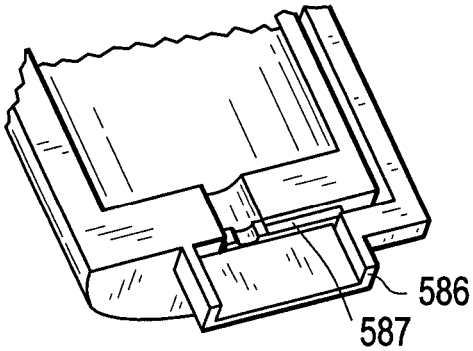
Figure 10C:
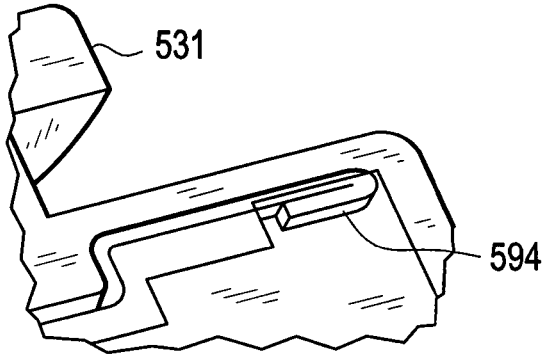

FIGS. 10A through 10C, illustrate additional detail views of the lamp high voltage connection to the secondary high voltage connection plate 587. Specifically, FIG. 10A illustrates the lamp high voltage track 596 which electrically connects to a lamp lead within the lamp receptacle base 531. The track 596 includes a pad 594 for electrically connecting the transformer high voltage secondary winding lead. FIG. 10B illustrates another view of the high voltage connection plate 587 and associated enclosure base 586. FIG. 10 illustrates another view of the lamp receptacle base 531 and associated lamp high voltage plate 594.

Figure 11A:
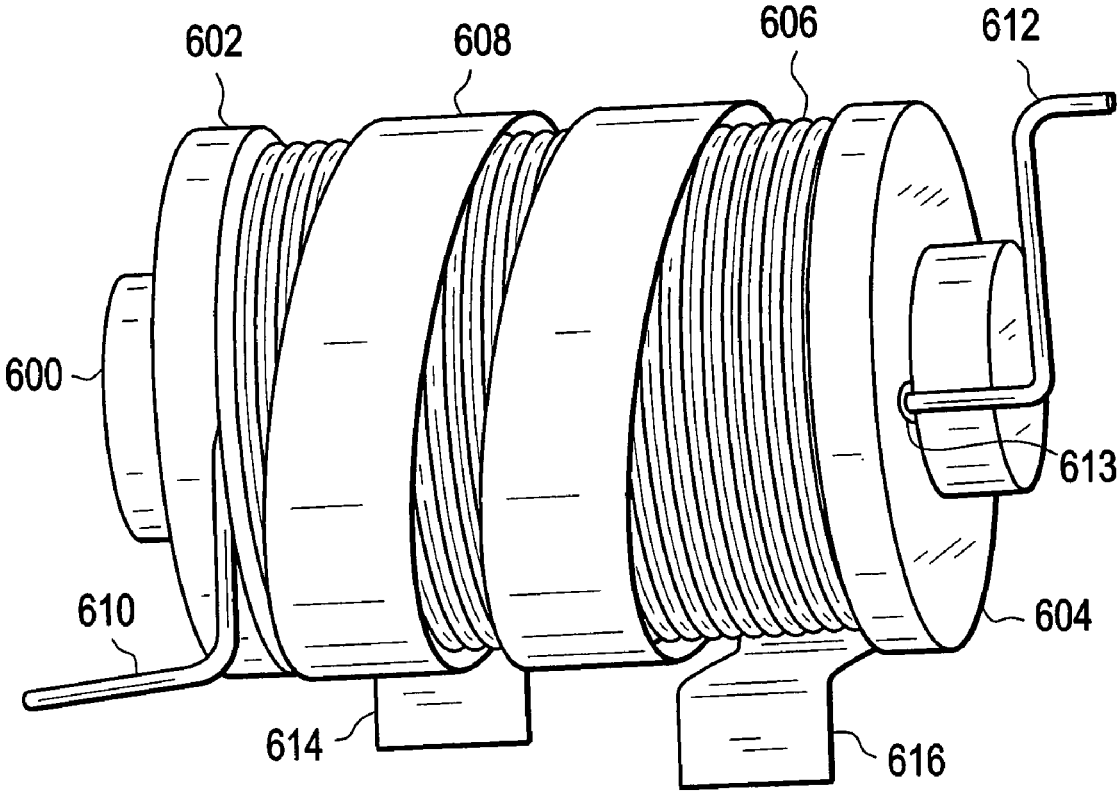
FIGS. 11A through 11C represent a lamp igniter transformer and method of assembly.
Figure 11B:
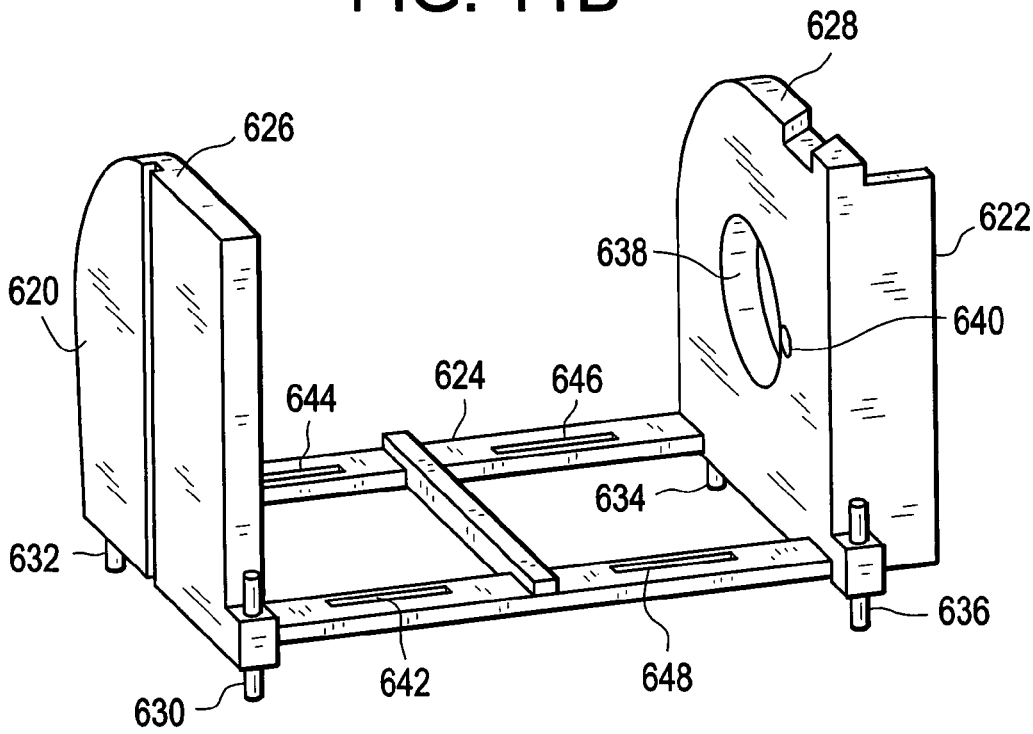
Figure 11C:
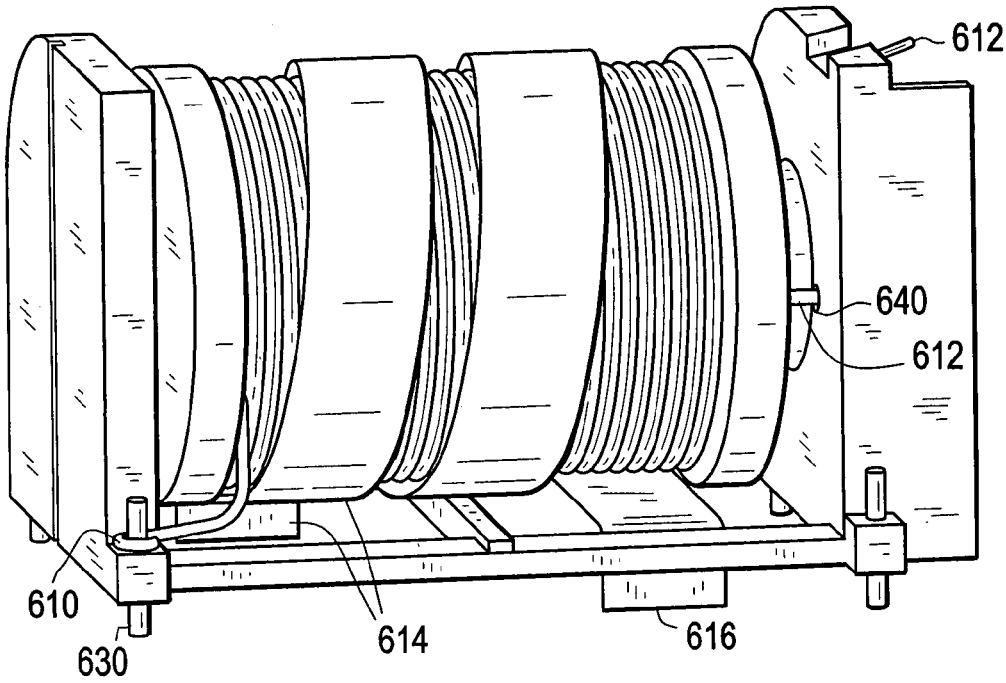

A completed unpotted lamp igniter transformer comprises a transformer core wound with a secondary and primary winding, and a carrier in FIGS. 11A-11C. Initially a transformer is constructed, the transformer comprising a rod core 600, margin tape 602 and 604, a secondary winding 606 and a primary winding 608. Initially, the secondary winding 606 is wound around the core 600, where margin tapes 602 and 604 define the extent of secondary winding 606 coverage along the core 600. Subsequently, the primary winding 608 is wound on the outside surface of the secondary winding 606. The secondary winding leads 610 and 612 are routed as illustrated in FIG. 11A, where secondary winding lead 612 is routed through a lead guide hole 613 extending through margin tape 604. The primary windings terminate with leads 614 and 616.

With reference to FIG. 11B, the transformer of FIG. 11A is attached to a carrier. The carrier includes a first end part 620, a second end part 622 axially spaced from the first end part, and a lead guide bridge 624 that extends between the first and second end parts. Carrier end part 620 has a locator slot 626 that cooperates with the housing, and locator posts 630, 632, while carrier end part 622 has a locator slot 628 and locator posts 634, 636. Each end part 620 and 622 also preferably includes a recess that is attached to the ends of the transformer core 600, for example, by means of adhesive and/or a pressed fit. Carrier end part 622 comprises recess 638 and carrier end part 620 comprises a recess located on the inside face of carrier end (not shown). In addition, carrier end part 622 includes a lead guide hole 640 for routing secondary winding lead 612.

The lead guide bridge 624 extends between carrier end parts 620 and 622, and has lead guides 642, 644, 646, 648 which are slot shaped to route/position the transformer primary winding leads 614, 616.

FIG. 11C illustrates the transformer illustrated in FIG. 11A after mounting to the carrier illustrated in FIG. 11B. As shown, primary winding leads 614 and 616 are routed through lead guides 644 and 648, respectively. Secondary winding lead 610 is attached to lead guide post 630 by means of soldering or welding and secondary winding lead 612 is routed through lead guide hole 640.

Figure 12A:
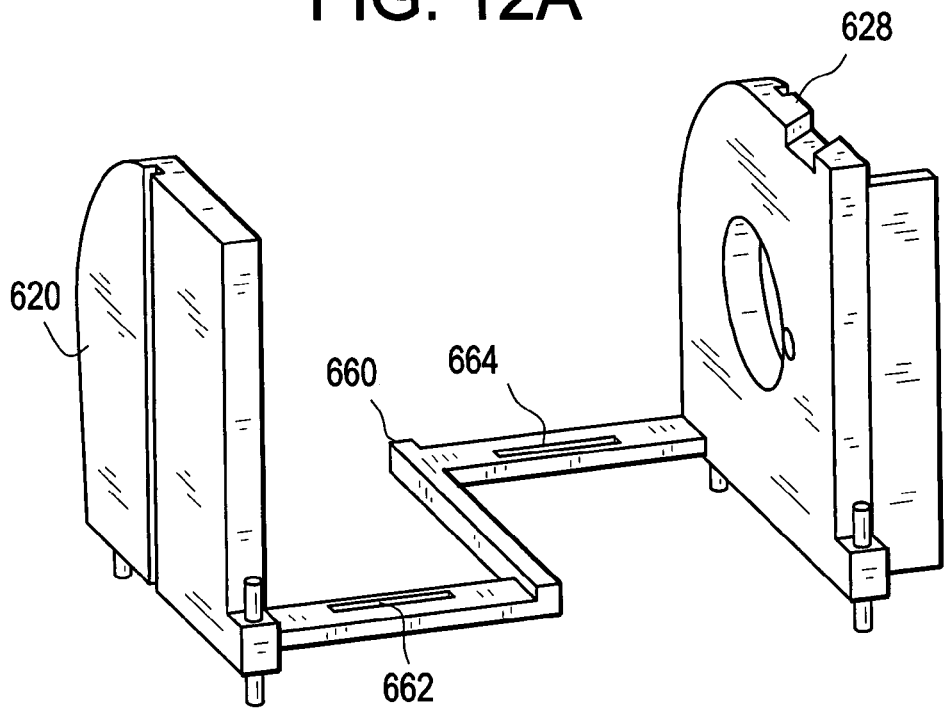
FIGS. 12A and 12B are perspective views of lamp igniter transformer carriers.
Figure 12B:
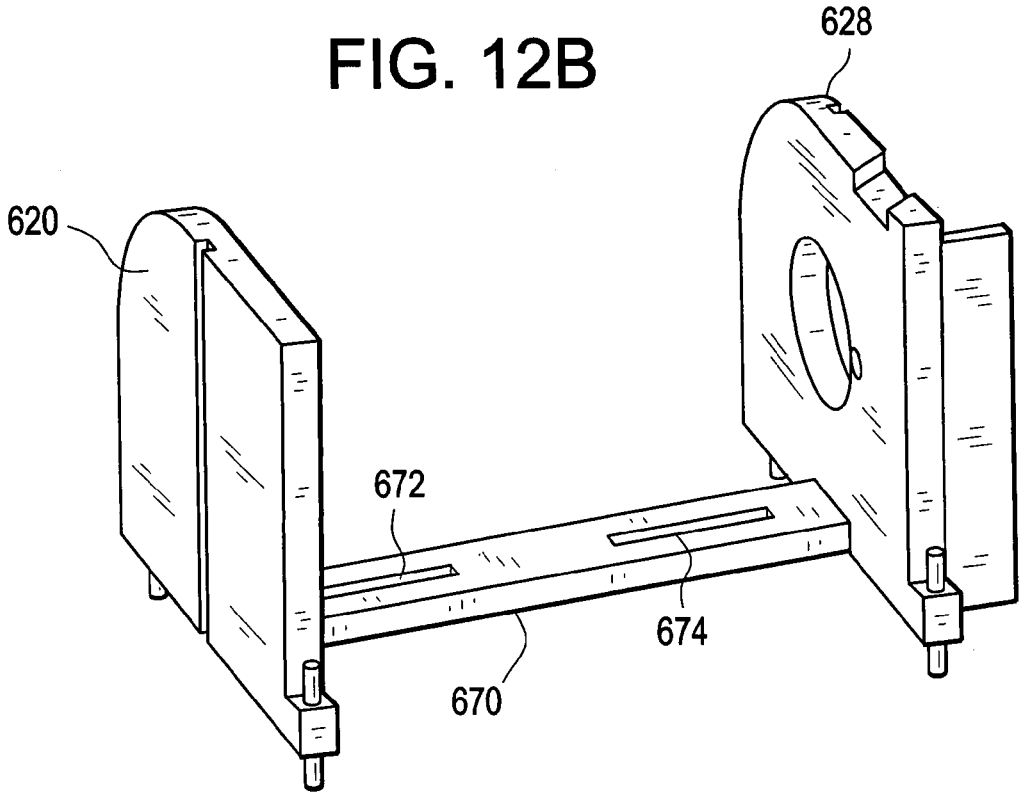

FIGS. 12A and 12B illustrate two additional transformer carrier embodiments. FIG. 12A illustrates a carrier comprising carrier end parts 620, 628, and a lead guide bridge including lead guide openings or elongated slots 662, 664. The lead guide bridge spans carrier end parts 620, 628, and is configured in a manner which provides horizontal offset alignment of the primary winding leads. FIG. 12B illustrates a carrier comprising a lead guide bridge 670 with horizontally aligned lead guide openings or elongated slots 672, 674. Notably, the carrier embodiments illustrated in FIGS. 12A and 12B are alternatives to other transformer carriers described in this disclosure, for example, the carrier illustrated and described with reference to FIG. 11B.

Figure 13A:
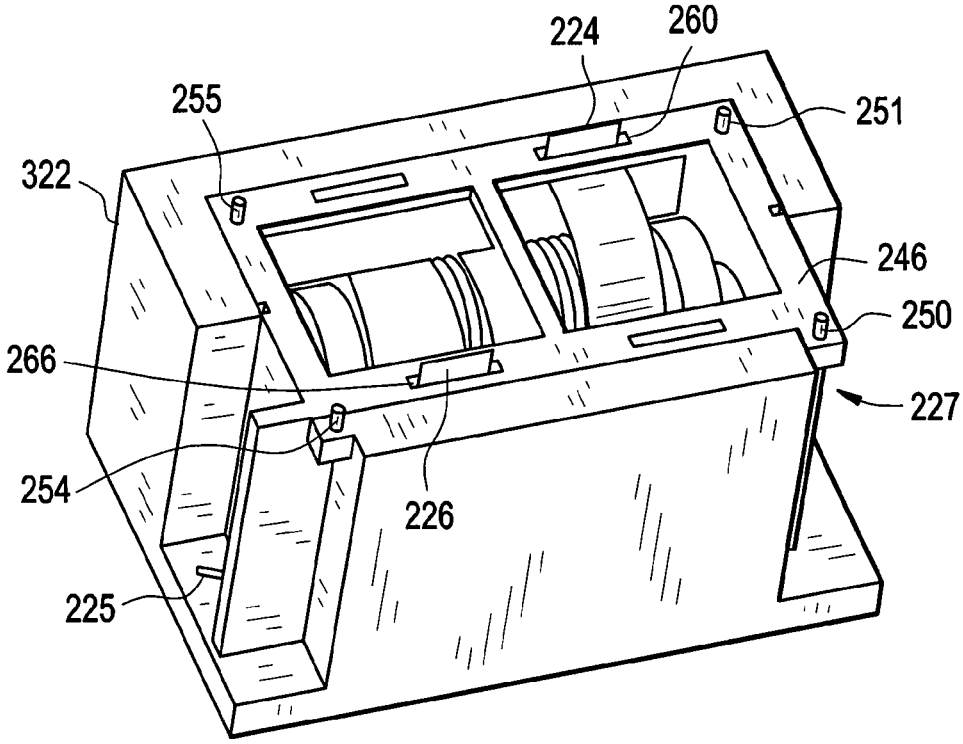
FIGS. 13A through 13D illustrate a further embodiment of a lamp igniter transformer and method of assembly.

An exemplary method of potting a transformer and carrier arrangement is shown with reference to FIG. 13A. Initially, an unpotted transformer attached to a carrier 246 is inserted into a potting mold 322. The transformer assembly comprises a carrier 246, primary winding leads 224, 226, and secondary winding leads 225, 227. The carrier includes locator posts 250, 251, 255, 254. Notably, the primary and secondary winding leads are located outside the potting mold where they will not be exposed to subsequently applied potting material. Specifically, primary winding leads 226, 224 are routed through lead guides 266, 260 respectively, and secondary winding lead 225 is located on an external face of a carrier end part with the second secondary winding lead attached to locator pin 250 at location 227.

Figure 13B:
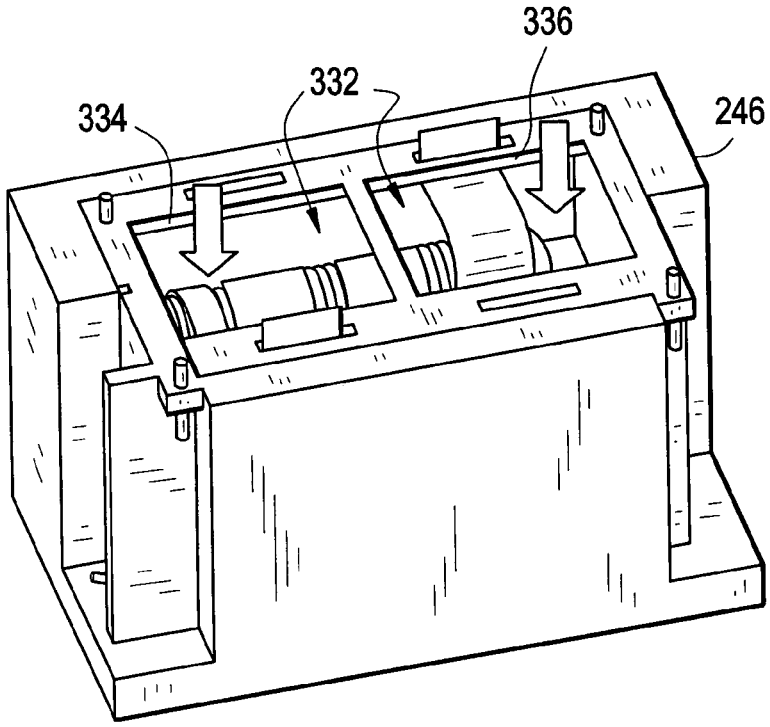

Next, as illustrated in FIG. 13B, potting material 332 is poured into the cavity of the potting mold through the openings created by the lead guide bridge of the transformer carrier. The carrier end parts serve as walls to contain the potting material for curing. Moreover, both methods of winding a transformer core can be completed within a broad range of primary and secondary insulated conductor winding sizes.

Figure 13C:
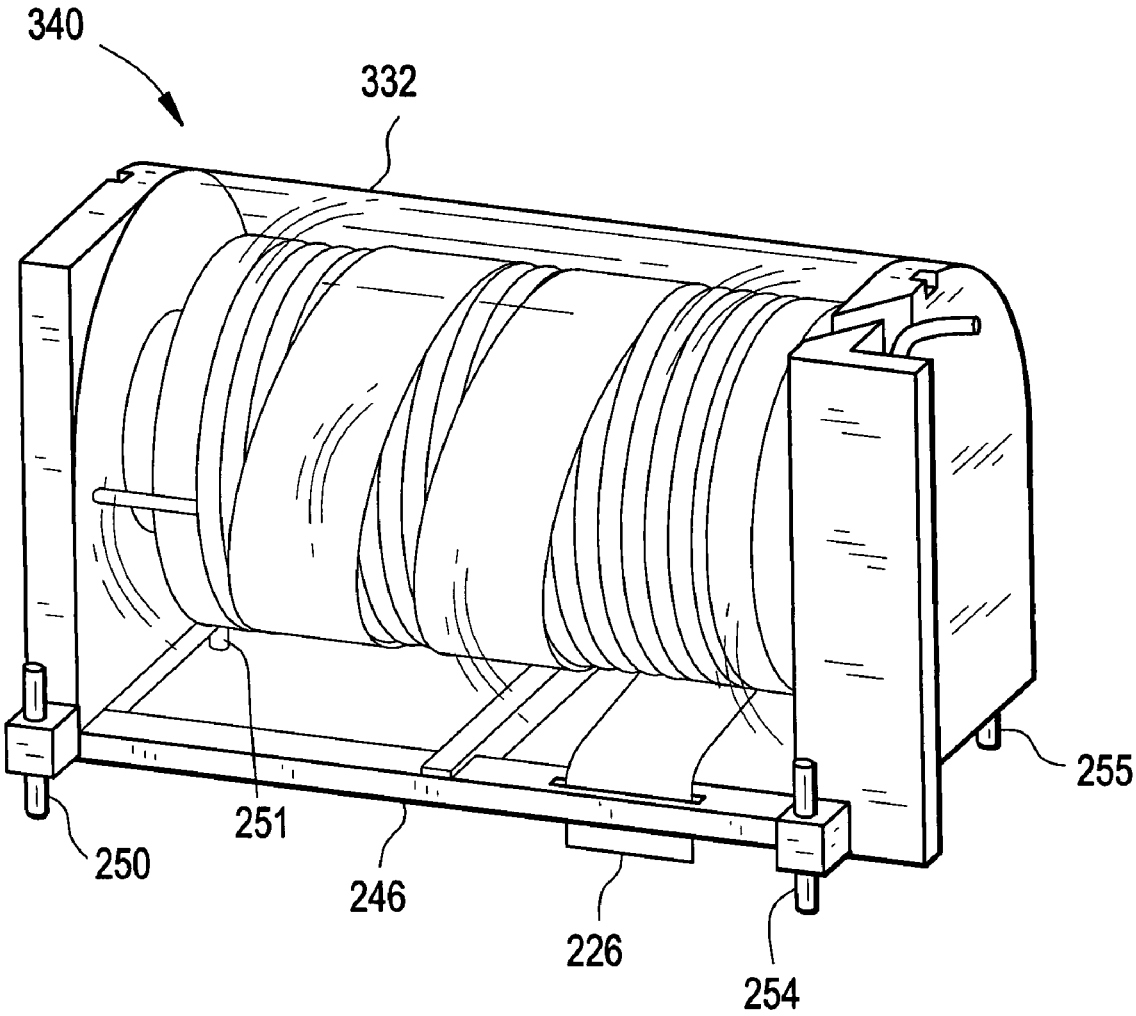

Next, as illustrated in FIG. 13C, the transformer and attached carrier are removed from the potting mold 246 resulting in a potted transformer 340.

Figure 13D:
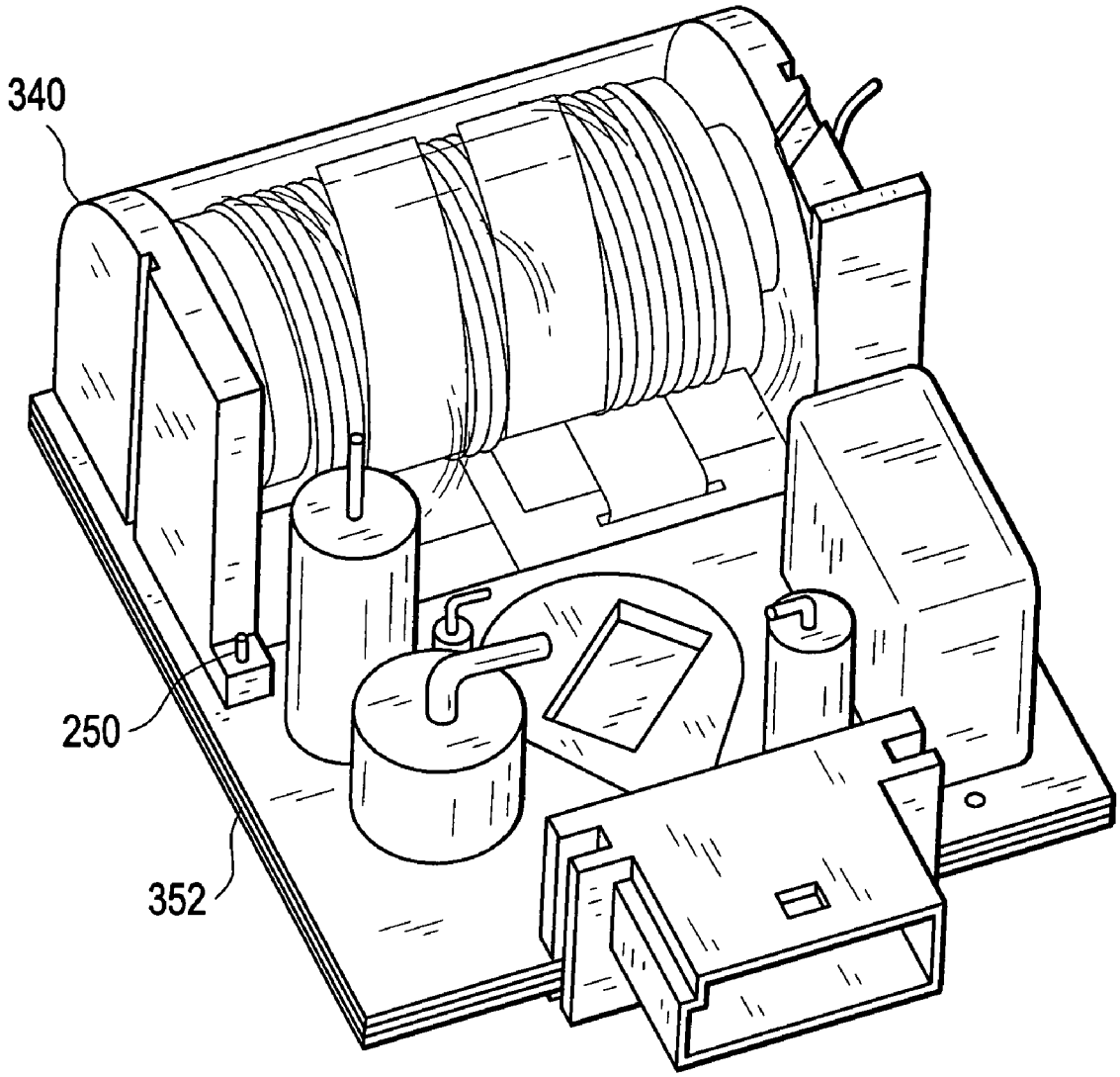

Finally, as illustrated in FIG. 13D, the potted transformer assembly 340 is attached to a lead frame or pc board 352 as previously discussed in this disclosure. At this point, the potted transformer and pc board assembly is ready to be placed within a lamp igniter module housing.

Figure 14A:
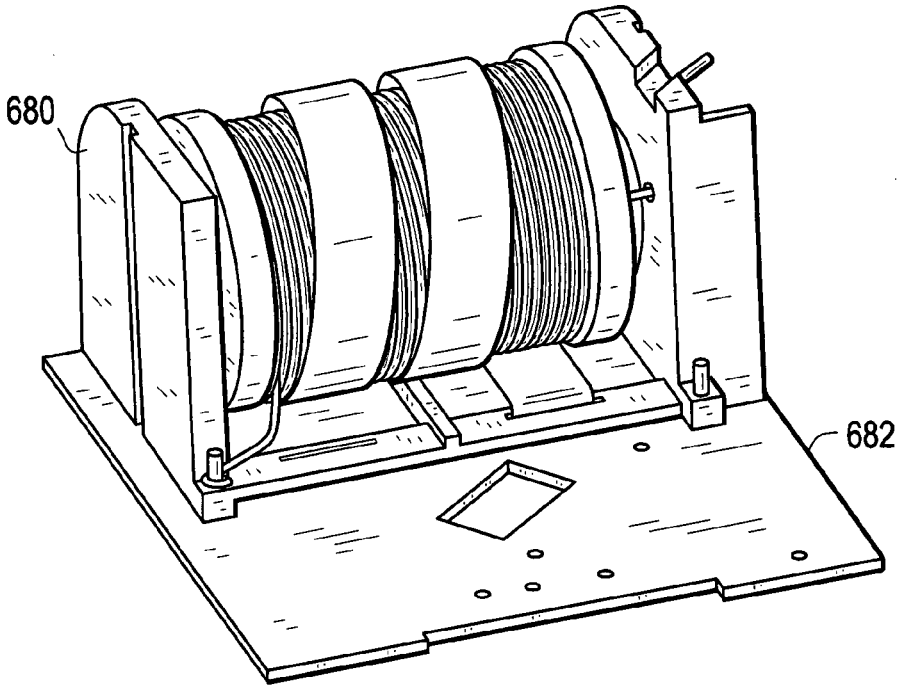
FIGS. 14A through 14D similarly show a still further embodiment of a lamp igniter transformer and method of assembly.
Figure 14B:
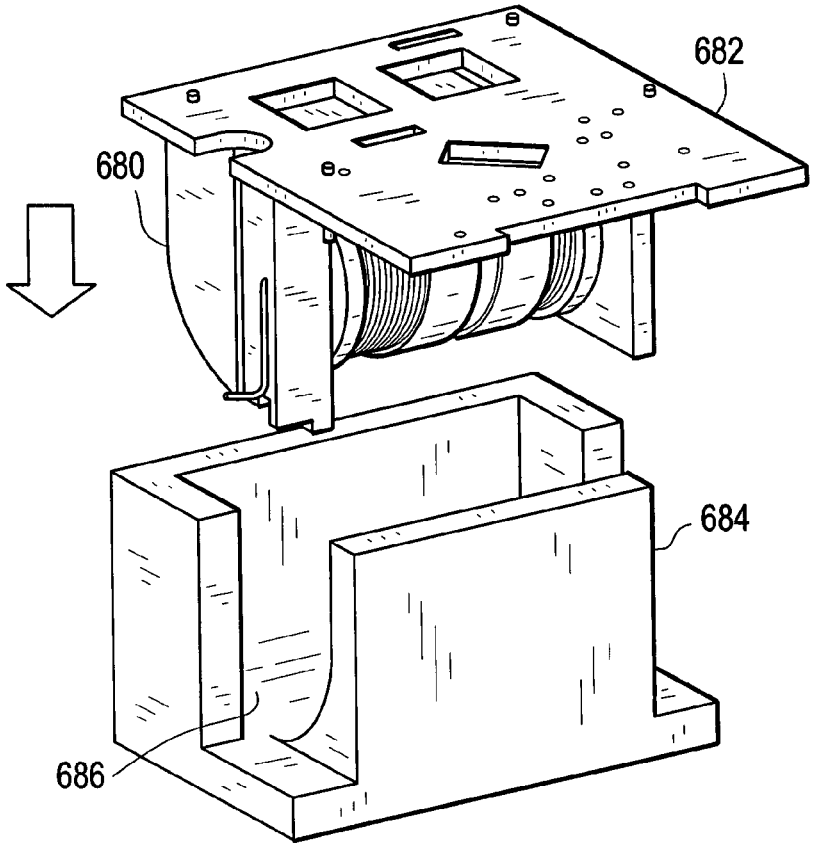

Another exemplary method of potting a transformer is shown in FIGS. 14A-14D. Unlike the potting method illustrated and discussed with reference to FIGS. 13A through 13D, this method comprises potting the transformer after the transformer and attached carrier are attached to a pc board. FIG. 14A shows an unpotted transformer 680 assembly attached to a pc board 682.

Next the pc board 682 and transformer assembly 680 are inserted into a potting mold 684 for potting. The potting mold 684 has a cavity 686 dimensioned to contain the transformer 680 and subsequently applied potting material. That is, the internal walls of the potting mold define the final contour and dimension of the potted transformer.

Figure 14C:
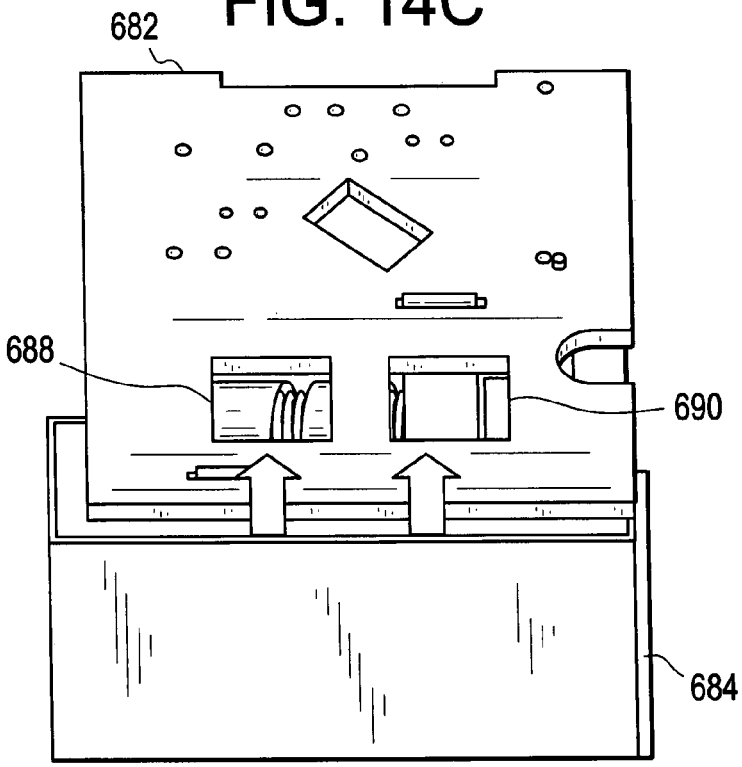

With reference to FIG. 14C, potting material is poured into the potting mold through pc board openings 688, 690 which are located above the transformer.

Figure 14D:
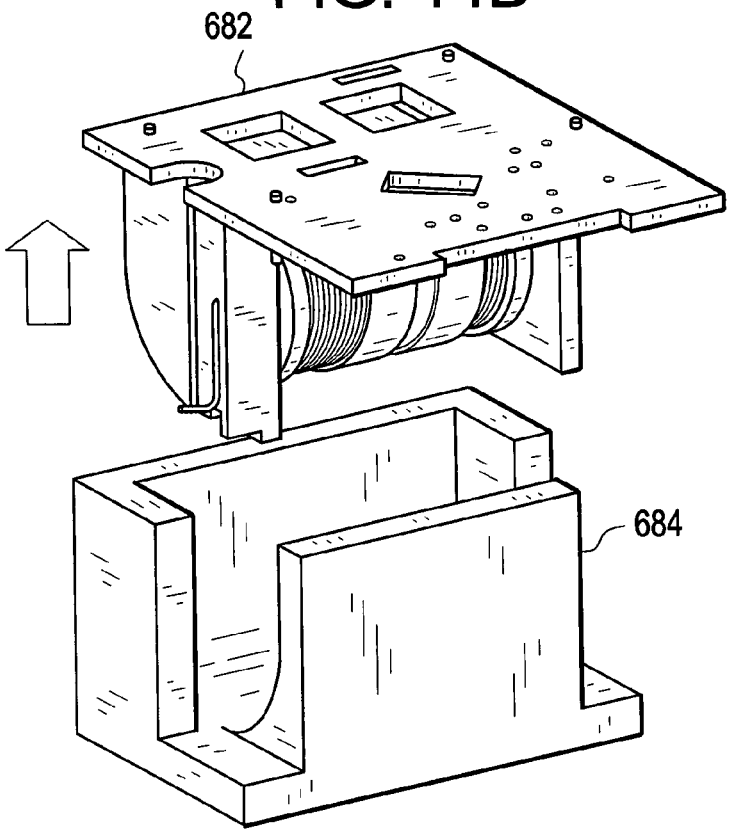

After the potting material has cured, the pc board 682 and attached transformer assembly are removed from the mold 684 (FIG. 14D).

At this point the potted transformer assembly and attached pc board are ready to be placed within a lamp igniter module housing in a manner as described previously herein.

Figure 15A:
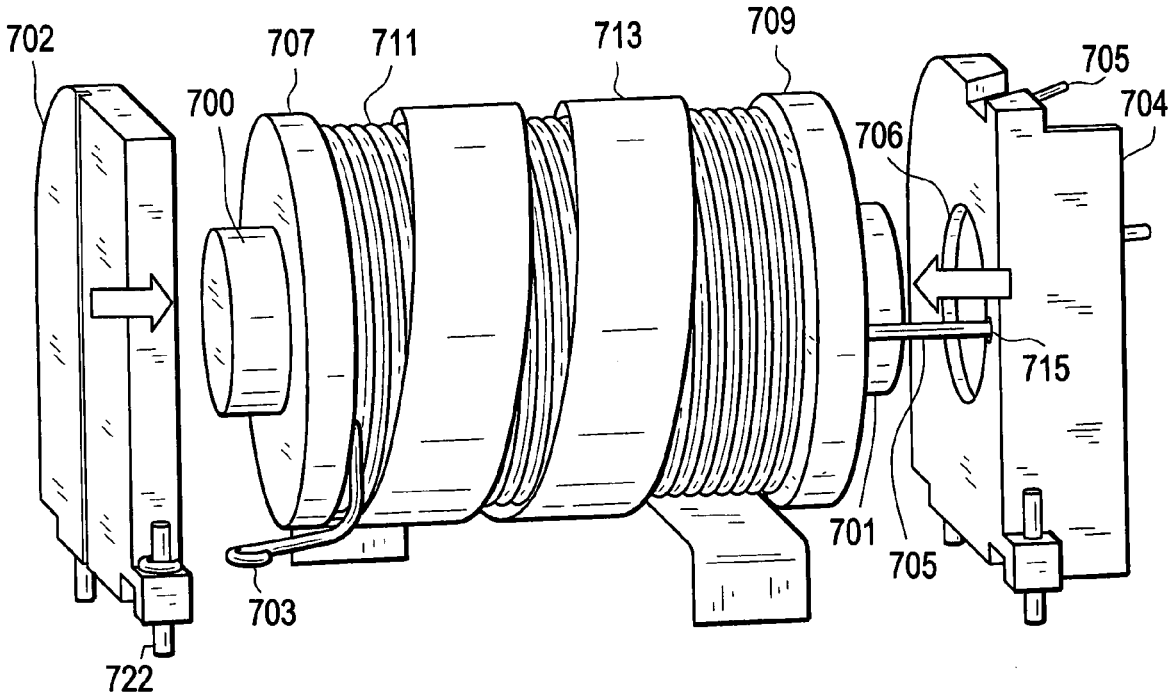
FIGS. 15A through 15C represent a lamp igniter transformer and method of preparing the lamp igniter transformer for potting.
Figure 15B:
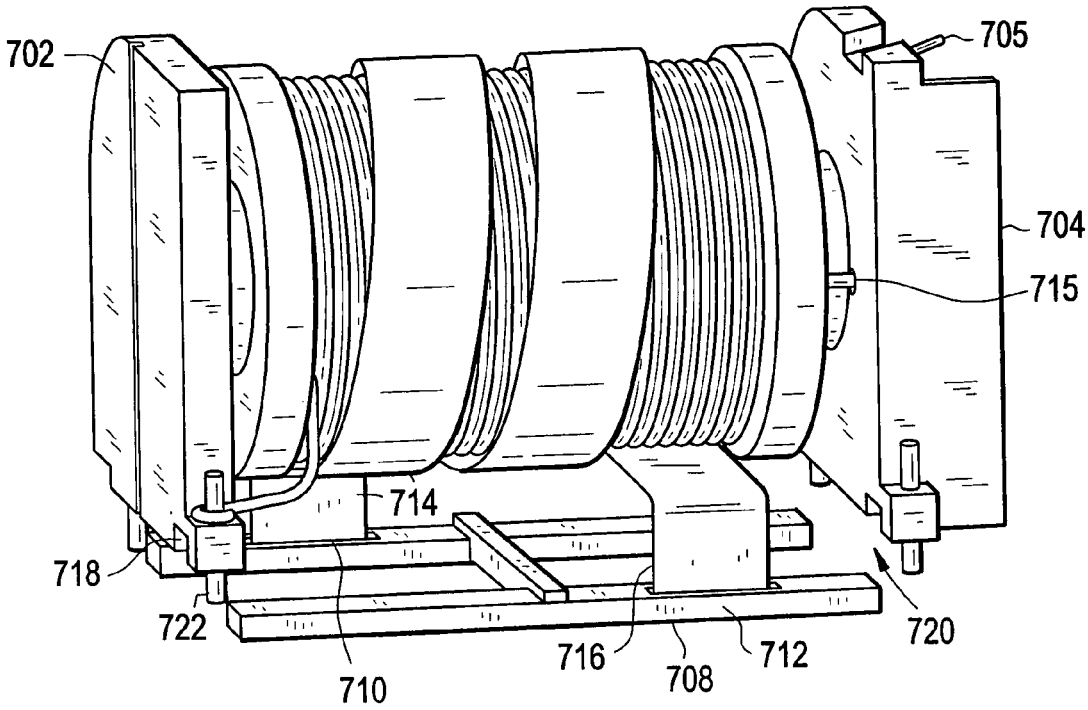
Figure 15C:
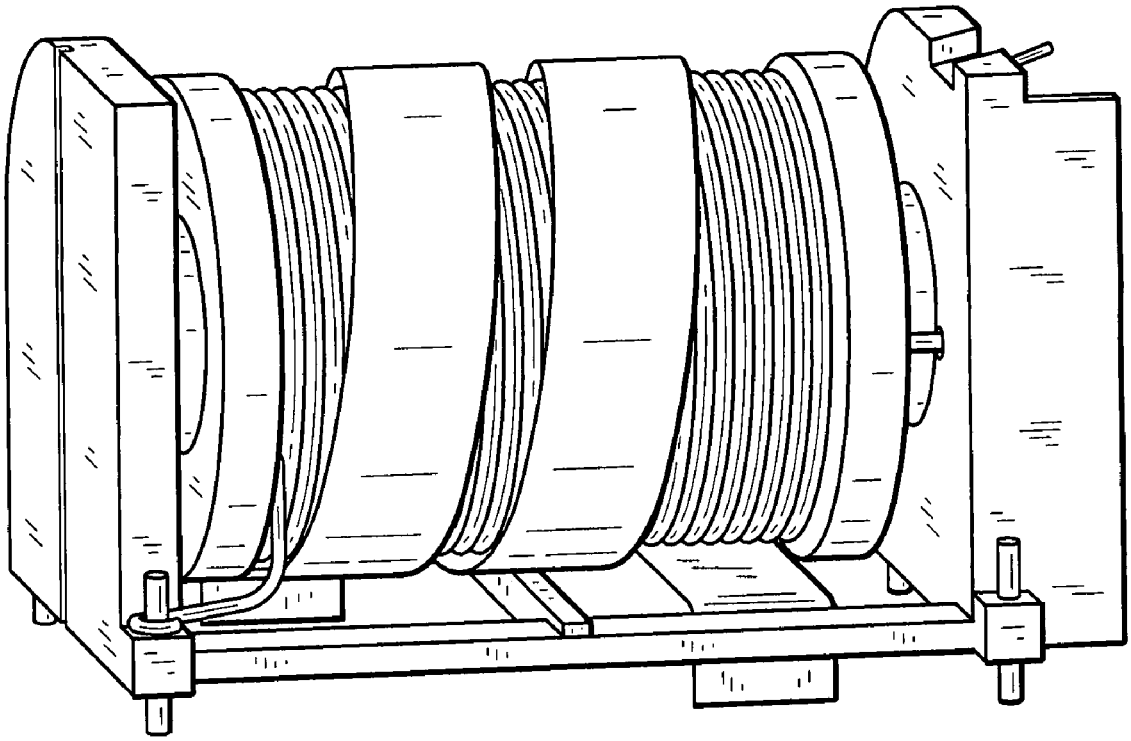

With reference to FIGS. 15A through 15C, illustrated are an exemplary series of steps to wind and assemble an unpotted transformer assembly that includes a carrier. The unpotted transformer assembly assembled according to this method may be subsequently potted and assembled within a lamp igniter module housing as previously discussed in this disclosure.

With reference to FIG. 15A, marking tape 707, 709 is applied to a rod core 700 to define the extent along the core of a subsequently applied secondary winding 711. Next, a secondary winding 711 is wound around the core 700 and a primary winding 713 is wound around the secondary winding. Notably, secondary winding lead 705 is routed through a carrier end part lead guide hole 715. Next, carrier end parts 702 and 704 are attached to the rod core ends by means of inserting the rod core 700 ends into recess 706 and another carrier recess is located on the inside surface of carrier end part 702. The core ends are attached to the carrier end pieces by means of a pressed fit, adhesive and/or other mechanical/chemical bonding means.

FIG. 15B illustrates the next step of installing a lead guide bridge which is glued and/or pressed into slots 718, 720 located on each carrier end part 702, 704, respectively. Other similar slots are provided on the back side of the carrier end parts 702, 704 to affix the lead guide bridge 708. The primary wind leads 714, 716 are routed through lead guides 710, 712, respectively, and secondary winding lead 703 is attached to locator post 722 by means of soldering or welding.

FIG. 15C illustrates an assembled unpotted transformer assembly with an attached carrier. Notably, the winding method described with reference to FIG. 15A can be completed with or without the carrier end parts attached.

Figure 16A:
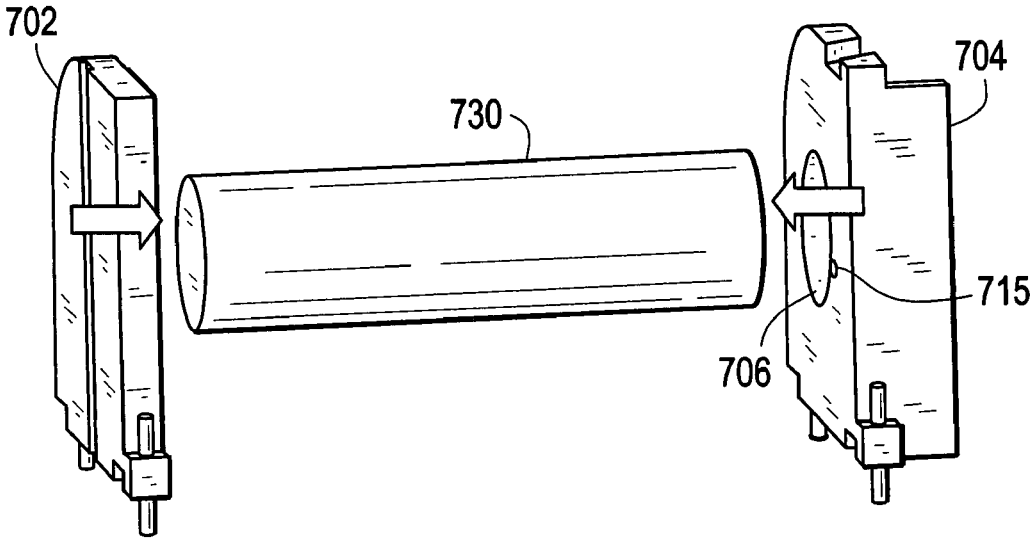
FIGS. 16A through 16D illustrate sequential steps of a lamp igniter transformer and method of assembling the lamp igniter transformer for potting.

With reference to FIG. 16A, initially a rod core is adhesively attached to carrier end parts 702, 704 and/or pressing the rod core ends into carrier end part recess 706 and a similar recess located on the inside of carrier end part 702.

Next, a secondary winding 711 is wound around the rod core 730 where the carrier end parts 702, 704 act as bobbin walls to define the extent of the secondary windings 711 along the core 730. Secondary winding lead 705 is routed through a lead guide 715 and secondary winding 703 is terminated at locator post 722. Subsequently, a primary winding 713 is wound around the secondary winding 711.

Figure 16B:
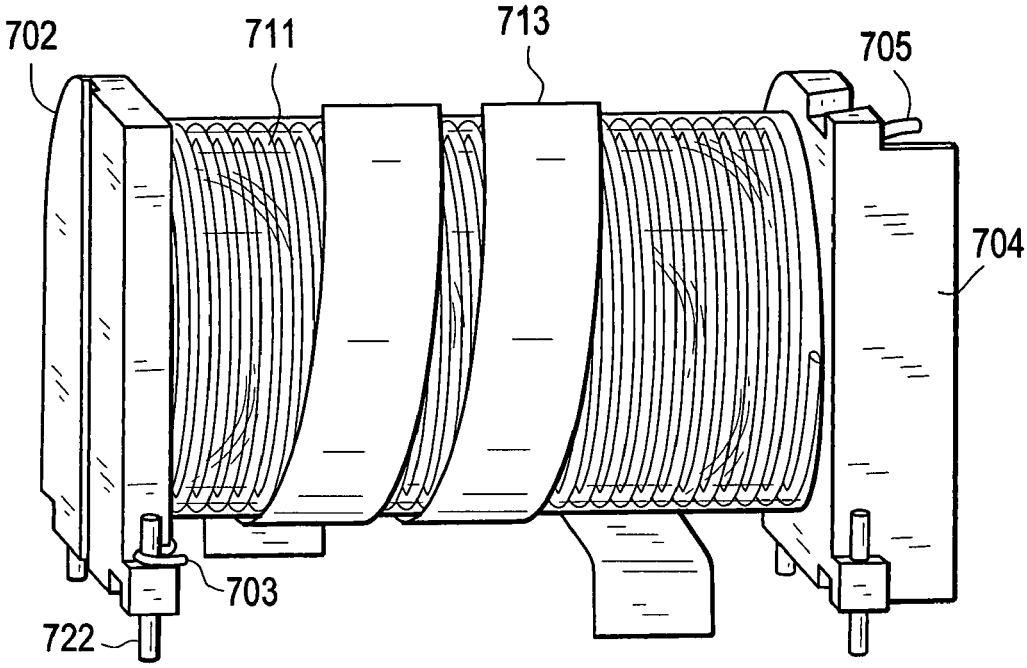
Figure 16C:
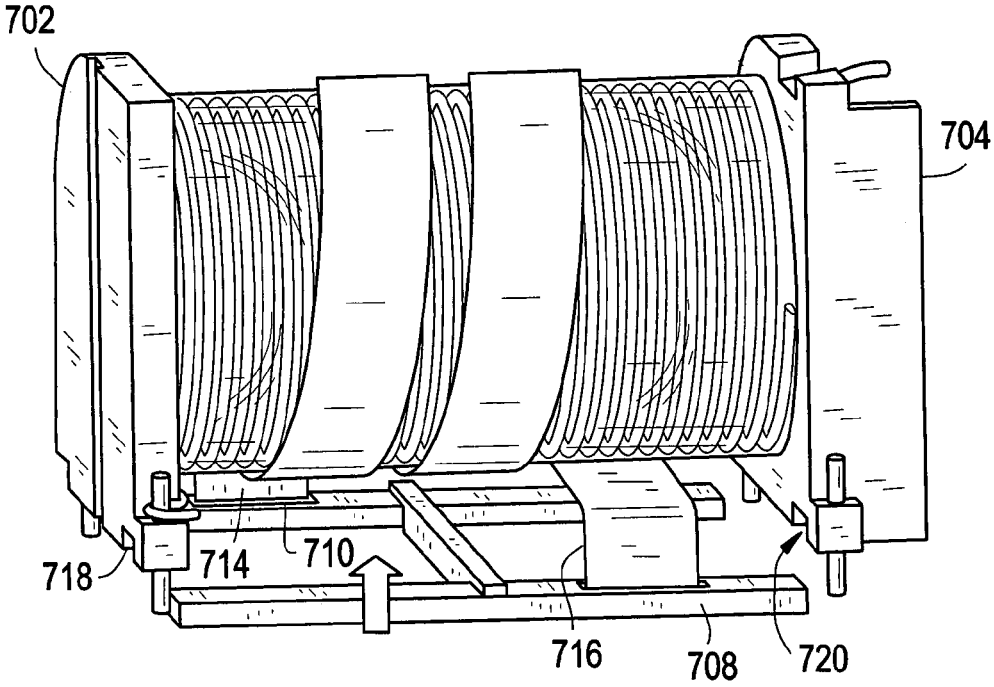

Next, the lead guide bridge is attached to the carrier as discussed with reference to FIG. 15B (see FIG. 16C).

Figure 16D:
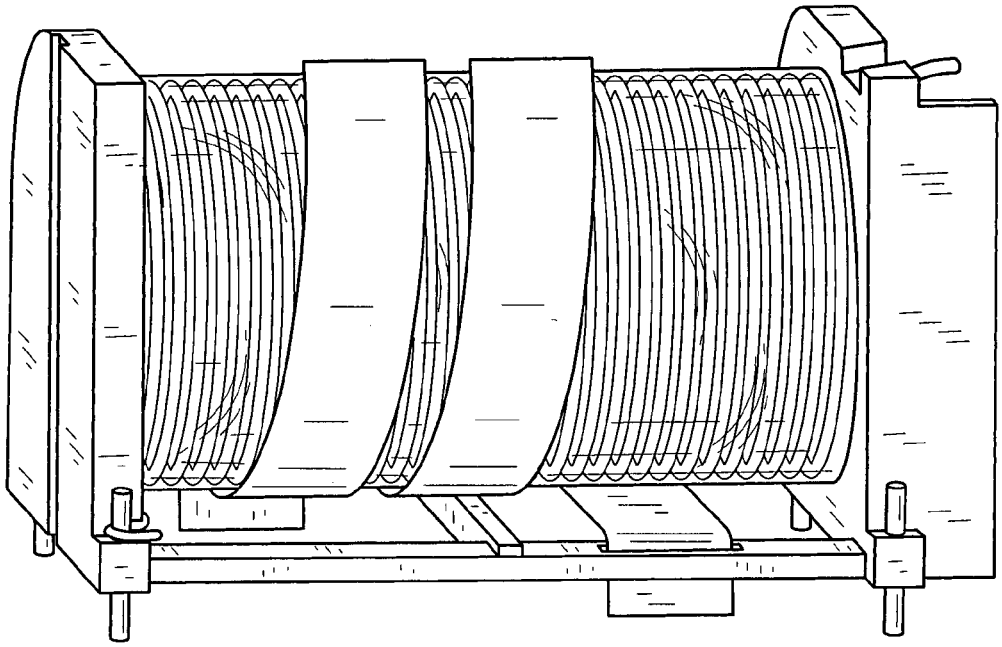

The completed unpotted transformer assembly with attached carrier is illustrated in FIG. 16D. Notably, the winding method described with reference to FIG. 16B is completed with the carrier end parts attached which eliminates the necessity of using marking tapes as discussed with reference to FIGS. 15A through 15C. The unpotted transformer assembly assembled according to the method of FIGS. 16A-D may be subsequently potted and assembled within lamp igniter module housing as previously discussed in this disclosure.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp igniter module comprising:

a potted igniter transformer including a rod core having a cylindrical or other polygonal cross-section and a plurality of windings along the length of the core;

a carrier attached to the potted igniter transformer;

a pc board on which the potted igniter transformer and carrier are mounted;

a housing for receiving the pc board, potted igniter transformer, and carrier; and wherein the carrier includes first and second end parts each attached to respective first and second ends of the core and wherein the housing comprises one or more locator features and the first and second end parts define one or more locator features for positioning the potted igniter transformer and carrier in a predetermined position in relation to the housing by mating the one or more housing locator features with the one or more end part locator features.

2. The module of claim 1, further comprising a means for positioning the potted igniter transformer and carrier in a predetermined position in relation to one or both of the pc board and housing.

3. The module of claim 1 further comprising margin tape wherein the margin tape defines the extent of the windings along the length of the core.

4. The module of claim 1 further comprising margin tape wherein the margin tape defines the extent of the potting along the length of the transformer.

5. The module of claim 1 wherein the first and second end parts form bobbin walls to define the extent of the windings along the length of the core.

6. The module of claim 1 wherein the first and second end parts form potting walls to define the extent of the potting along the length of the transformer.

7. The module of claim 1 wherein the first and second end parts each have one or more locator pins for positioning the potted igniter transformer and carrier in a predetermined position on the pc board.

8. The module of claim 1 wherein the housing locator feature comprises a tab and the end part locator feature comprises a slot.

9. A lamp igniter module comprising:

a potted igniter transformer including a rod core having a cylindrical or other polygonal cross-section and a plurality of windings along the length of the core;

a carrier attached to the potted igniter transformer;

a pc board on which the potted igniter transformer and carrier are mounted; and a housing for receiving the pc board, potted igniter transformer, and carrier;

wherein the carrier is adapted to position the potted igniter transformer and carrier in a predetermined position in relation to one or both of the pc board and the housing, and wherein the transformer windings comprise a primary winding and a secondary winding, each of said windings terminating in a pair of connection leads and wherein the carrier comprises a lead guide to position at least one of the primary or secondary leads in relation to a respective connection point on the pc board.

10. The module of claim 9 wherein the lead guide bridges the first and second end parts and comprises one or more openings through which a respective lead is routed.

11. The module of claim 9, further comprising a means for positioning the potted igniter transformer and carrier in a predetermined position in relation to one or both of the pc board and housing.

12. The module of claim 9 further comprising margin tape wherein the margin tape defines the extent of the windings along the length of the core.

13. The module of claim 9 further comprising margin tape wherein the margin tape defines the extent of the potting along the length of the transformer.

14. The module of claim 9 wherein the carrier forms bobbin walls to define the extent of the windings along the length of the core.

15. The module of claim 9 wherein the carrier forms potting walls to define the extent of the potting along the length of the transformer.

16. The module of claim 9 wherein the carrier has one or more locator pins for positioning the potted igniter transformer and carrier in a predetermined position on the pc board.

17. The module of claim 9 wherein the housing includes a tab and the carrier includes a slot for locating the housing relative to the carrier.

18. A lamp igniter module comprising:

a potted igniter transformer including a rod core having a cylindrical or other polygonal cross-section and a plurality of windings along the length of the core;

a carrier attached to the potted igniter transformer;

a pc board on which the potted igniter transformer and carrier are mounted;

a housing for receiving the pc board, potted igniter transformer, and carrier; and wherein the carrier is adapted to position the potted igniter transformer and carrier in a predetermined position in relation to one or both of the pc board and the housing wherein the transformer windings comprise a primary winding and a secondary winding each of said windings terminating in a pair of connection leads and wherein the carrier comprises at least one lead guide hole to route at least one of said connection leads.

19. The module of claim 18 further comprising margin tape wherein the margin tape defines the extent of the windings along the length of the core.

20. The module of claim 18 further comprising margin tape wherein the margin tape defines the extent of the potting along the length of the transformer.

21. The module of claim 18 wherein the carrier forms bobbin walls to define the extent of the windings along the length of the core.

22. The module of claim 18 wherein the carrier forms potting walls to define the extent of the potting along the length of the transformer.

23. The module of claim 18 wherein the carrier has one or more locator pins for positioning the potted igniter transformer and carrier in a predetermined position on the pc board.

24. The module of claim 18 wherein the housing includes a tab and the carrier includes a slot for locating the housing relative to the carrier.

* * * * *